United States Patent [19]

Marshall et al.

[11] 4,336,018

[45] Jun. 22, 1982

[54] ELECTRO-OPTIC INFANTRY WEAPONS TRAINER

[75] Inventors: Albert H. Marshall, Orlando; Bon F. Shaw, Winter Park; Herbert C. Towle, Maitland, all of Fla.; Thomas J. Riordan, Santa Clara, Calif.; George A. Siragusa, Winter Park, Fla.

[73] Assignee: The United States of America as represented by the Secretary of the Navy, Washington, D.C.

[21] Appl. No.: 105,313

[22] Filed: Dec. 19, 1979

[51] Int. Cl.[3] ..... F41J 5/08; F41J 5/10

[52] U.S. Cl. ..... 434/22; 434/20

[58] Field of Search ..... 434/18, 19, 20, 21, 434/22, 25, 26; 273/310, 311, 312, DIG. 28

[56] References Cited

U.S. PATENT DOCUMENTS

| | | | |
|---|---|---|---|
| 2,708,319 | 5/1955 | Tratsch | 434/18 |
| 3,964,178 | 6/1976 | Marshall et al. | 434/22 |
| 4,177,580 | 12/1979 | Marshall et al. | 434/22 |

*Primary Examiner*—Vance Y. Hum
*Assistant Examiner*—Leo P. Picard
*Attorney, Agent, or Firm*—Robert F. Beers; Robert W. Adams; David S. Kalmbaugh

[57] ABSTRACT

An electro-optic infantry weapons training system for simulating the firing of a quintet of weapons at a visual target which appears upon a screen. A quintet of trainee riflemen, each of whom is holding a weapon, aim and fire the weapons at the visual target. A visual projector projects upon the screen a background scene including the visual target, while an infrared projector simultaneously projects upon the screen an infrared target. Each weapon includes a sensor element for sensing the infrared target whenever the weapon is correctly aimed at the visual target. The sensor elements are connected in a unique combination with sensor circuits, enable circuits, and an interface circuit so as to provide to a microprocessor computer and an eight-bit microcomputer data words which indicate whether each of the quintet of trainee riflemen have scored a hit upon the visual target. The microprocessor computer then supplies a message to a voice unit so as to indicate to an instructor and each of the quintet of trainee riflemen whether the trainee rifleman has scored a hit upon the visual target. The eight-bit microcomputer supplies to a data CRT display a message so as to indicate to the instructor whether each of the five trainee riflemen have scored a hit upon the visual target. At the conclusion of a training session, the microprocessor computer will supply to a data terminal, in accordance with a message format, the results of the training session.

31 Claims, 15 Drawing Figures

| COMPUTER TRUTH TABLE | | | | |
|---|---|---|---|---|
| OUTPUT TO DATA CRT DISPLAY AND VOICE UNIT | PHOTO DIODE HIT | | | |
| | 123 | 125 | 127 | 129 |
| HIT | 1 | 1 | 1 | 1 |
| HIGH RIGHT | 0 | 1 | 0 | 0 |
| HIGH LEFT | 1 | 0 | 0 | 0 |
| HIGH | 1 | 1 | 0 | 0 |
| LOW LEFT | 0 | 0 | 0 | 1 |
| LOW RIGHT | 0 | 0 | 1 | 0 |
| LEFT | 1 | 0 | 0 | 1 |
| RIGHT | 0 | 1 | 1 | 0 |
| LOW | 0 | 0 | 1 | 1 |
| MISS OR NO TARGET | 0 | 0 | 0 | 0 |

FIG. 9

| WEAPON TRUTH TABLE | | | |
|---|---|---|---|
| ADDRESS FROM MICROPROCESSOR COMPUTER TO 8-BIT COMPUTER | | | WEAPON |
| 0 | 0 | 1 | WEAPON 11 |
| 0 | 1 | 0 | WEAPON 12 |
| 0 | 1 | 1 | WEAPON 14 |
| 1 | 0 | 0 | WEAPON 16 |
| 1 | 0 | 1 | WEAPON 18 |

FIG. 14

| DECODER TRUTH TABLE | | | | | |
|---|---|---|---|---|---|
| ADDRESS PROVIDED BY MICROPROCESSOR COMPUTER TO DECODER | | | | COMPONENT | FUNCTION |
| 0 | 0 | 0 | 1 | LATCH 189 | LATCH TO INPUT DATA WORD TO MICROPROCESSOR COMPUTER |
| 0 | 0 | 1 | 0 | LATCH 191 | |
| 0 | 0 | 1 | 1 | LATCH 193 | |
| 0 | 1 | 0 | 0 | LATCH 195 | |
| 0 | 1 | 0 | 1 | LATCH 197 | |
| 0 | 1 | 1 | 0 | RIFLE ELECT CIRC 47 | RIFLE ELECTRONICS CIRCUIT TO BE RESET |
| 0 | 1 | 1 | 1 | RIFLE ELECT CIRC 181 | |
| 1 | 0 | 0 | 0 | RIFLE ELECT CIRC 183 | |
| 1 | 0 | 0 | 1 | RIFLE ELECT CIRC 185 | |
| 1 | 0 | 1 | 0 | RIFLE ELECT CIRC 187 | |
| 1 | 0 | 1 | 1 | LATCHES 189-197 | CLEAR LATCHES 189-197 |
| 1 | 1 | 0 | 0 | VOICE UNIT 55 | ACTIVATE VOICE UNIT |
| 1 | 1 | 0 | 1 | DATA TERM 63 | ACTIVATE DATA TERM |
| 1 | 1 | 1 | 0 | | NOT UTILIZED |
| 1 | 1 | 1 | 1 | | NOT UTILIZED |

FIG. 12

| TRUTH TABLE FOR VOICE UNIT | | | | | | |
|---|---|---|---|---|---|---|
| DATA WORD FROM COMPUTER TO VOICE UNIT | | | | | | MESSAGE |
| 0 | 0 | 0 | 0 | 0 | 1 | LOW |
| 0 | 0 | 0 | 0 | 1 | 0 | RIGHT |
| 0 | 0 | 0 | 0 | 1 | 1 | LEFT |
| 0 | 0 | 0 | 1 | 0 | 0 | HIT |
| 0 | 0 | 0 | 1 | 0 | 1 | MISS |
| 0 | 0 | 0 | 1 | 1 | 0 | NO |
| 0 | 0 | 0 | 1 | 1 | 1 | TARGET |
| 0 | 0 | 1 | 0 | 0 | 0 | SOLDIER |
| 0 | 0 | 1 | 0 | 0 | 1 | YOU |
| 0 | 0 | 1 | 0 | 1 | 0 | A |
| 0 | 0 | 1 | 0 | 1 | 1 | WAS |
| 0 | 0 | 1 | 1 | 0 | 0 | MARINE |
| 0 | 0 | 1 | 1 | 0 | 1 | ENEMY |
| 0 | 0 | 1 | 1 | 1 | 0 | HIGH |
| 0 | 0 | 1 | 1 | 1 | 1 | FROZE |
| 0 | 1 | 0 | 0 | 0 | 0 | LEAD |
| 0 | 1 | 0 | 0 | 0 | 1 | GOOD |
| 0 | 1 | 0 | 0 | 1 | 0 | SHOT |
| 0 | 1 | 0 | 0 | 1 | 1 | WINNER |
| 0 | 1 | 0 | 1 | 0 | 0 | FRONT |
| 0 | 1 | 0 | 1 | 0 | 1 | SWITCH |
| 0 | 1 | 0 | 1 | 1 | 0 | UP |
| 0 | 1 | 0 | 1 | 1 | 1 | FRIENDLY |
| 0 | 1 | 1 | 0 | 0 | 0 | READY |
| 0 | 1 | 1 | 0 | 0 | 1 | DUCK |
| 0 | 1 | 1 | 0 | 1 | 0 | ONE |
| 0 | 1 | 1 | 0 | 1 | 1 | TWO |
| 0 | 1 | 1 | 1 | 0 | 0 | THREE |
| 0 | 1 | 1 | 1 | 0 | 1 | FOUR |
| 0 | 1 | 1 | 1 | 1 | 0 | FIVE |
| 0 | 1 | 1 | 1 | 1 | 1 | ALERT |
| 1 | 0 | 0 | 0 | 0 | 0 | AVAILABLE |

FIG. 13

ELECTRO-OPTIC INFANTRY WEAPONS TRAINER

BACKGROUND OF THE INVENTION

1. Field of the Invention

The present invention in general relates to training simulators. In particular, the present invention relates to a weapons training simulator system for allowing a trainee rifleman to fire a weapon without the requirement of live ammunition.

2. Description of the Prior Art

Heretofore, numerous weapon simulator devices have been utilized in shooting galleries, for training riflemen in combat situations, and other places. As a matter of fact, such weapon simulator devices are so numerous in quantity that further discussion thereof is unnecessary at this time. Thus, suffice it to say that there are some general similarities between them and the subject invention, but the structures and functions of the subject invention are quite different and a considerable improvement over the prior art.

U.S. Pat. No. 3,964,178 entitled Universal Infantry Weapons Trainer, to Albert H. Marshall, Frank J. Oharek, John H. Dillard, and Robert J. Entwistle, is the closest known prior art of the subject invention. A universal infantry weapons trainer is disclosed therein in which frames of motion picture film are employed to produce simultaneously from one set of frames, a background area which includes a visual target and, from another set of frames, an infrared lead aim spot. The sets of film frames are coordinated in projection and in a desired degree of nonregistration between the lead spot and the target by a selsyn circuit, so as to provide a lead in the infrared spot that is representative of the correct lead and an indication of whether or not a weapon is properly aimed. Also disclosed is a receiver circuit comprising a quadrant arrangement of infrared detectors for sensing the infrared lead aim spot combined with amplifiers, comparators, logic, and means for indicating a bullseye "hit" on a target or a specific area of near miss relative to the target on the field of view displaying it.

Unfortunately, the aforementioned devices of the prior art ordinarily leave something to be desired, especially from the standpoints of accuracy, complexity, and target information efficiency. Moreover, with respect to the former, sophistication and, hence, the quality thereof only need be that which is sufficient for entertainment purposes. With respect to the Universal Infantry Weapons Trainer, this training system does not operate exactly the same as the subject invention, and contains a combination of elements that is somewhat different from that of the present invention. In particular, the Universal Infantry Weapons Trainer provides for the processing of data information received from only one weapon during a training session, thereby limiting the number of trainee riflemen that can utilize the aforementioned training system during the training session.

SUMMARY OF THE INVENTION

The subject invention overcomes some of the disadvantages of the prior art, including those mentioned above, in that it comprises a unique weapon trainer system which may be utilized by a quintet of trainee riflemen, each of whom is aiming and firing a weapon at a visual target appearing upon a screen.

A visual projector projects upon the screen a background scene including the visual target, while an infrared projector simultaneously projects upon the screen an infrared target. Each weapon has mounted thereon a sensor element adopted for sensing the infrared target. The sensor element will sense the infrared target when the weapon is correctly aimed, and provide at the output thereof analog output signals which are converted to a data word by a quartet of sensor circuits.

The digital data words provided by each of the five weapons is, in turn, stored in an interface circuit to await processing by a microprocessor computer. The microprocessor computer will then supply to the interface circuit a data-ready pulse, thereby causing the transfer of a data word from the interface circuit to the microprocessor computer. The microprocessor computer will process, in accordance with a predetermined truth table, the aforementioned data word so as to determine whether the trainee rifleman has scored a hit upon the visual target. The microprocessor computer then supplies to a voice unit a message so as to indicate to the trainee rifleman and an instructor whether the trainee rifleman has scored a hit upon the visual target. The microprocessor computer also supplies the aforementioned data word to an eight-bit microcomputer which processes the data word in accordance with the predetermined truth table, and then provides a message to a data CRT display, thereby indicating to the instructor whether the trainee rifleman has scored a hit upon the visual target.

BRIEF DESCRIPTION OF THE DRAWINGS

FIG. 9 is a truth table utilized by the microprocessor computer of FIG. 2 and the eight-bit microcomputer of FIG. 4;

FIG. 12 is a truth table utilized by the decoder of FIG. 4;

FIG. 13 is a truth table utilized by the voice unit of FIG. 2;

FIG. 14 is a truth table utilized by the eight-bit microcomputer of FIG. 4.

DESCRIPTION OF THE PREFERRED EMBODIMENT

Figure 1:
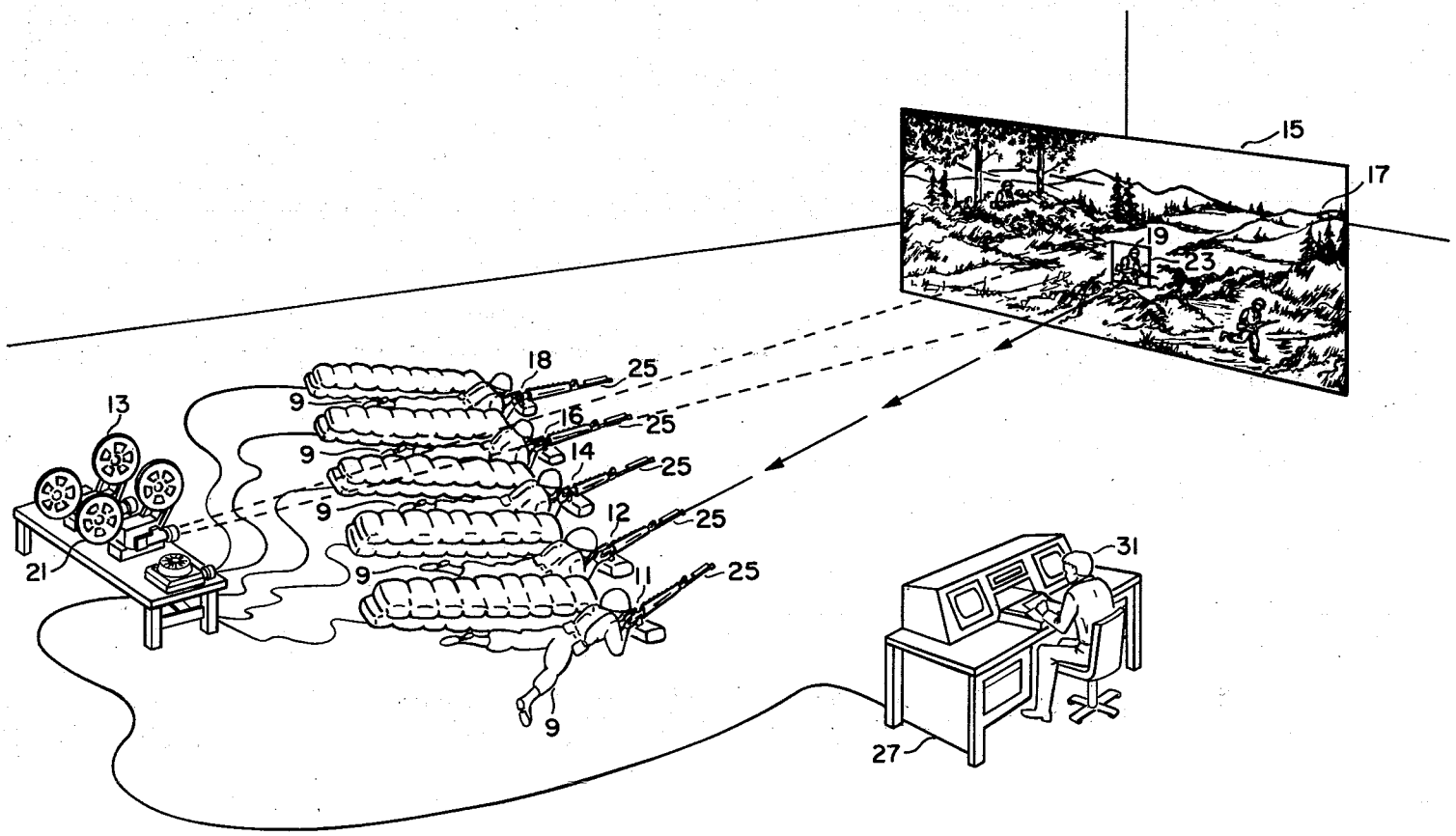
FIG. 1 is a pictorial representation of the subject invention.

The preferred embodiment of the subject invention will now be discussed in some detail in conjunction with all of the figures of the drawings, wherein like parts are designated by like reference numerals, insofar as it is possible and practical to do so.

Referring now to the pictorial representation of FIG. 1, there is shown a quintet of trainee riflemen 9, each of whom is holding and firing a weapon, herein defined as weapon 11, 12, 14, 16, or 18. Positioned directly behind the quintet of trainee riflemen 9 is a visual projector 13 for projecting upon a screen 15 a background scene 17 including a visual target 19. Positioned adjacent to visual projector 13 is an infrared projector 21 for simultaneously projecting upon screen 15 an infrared target 23. Each of the aforesaid weapons has attached to the barrel thereof a sensor element 25 adapted for sensing infrared target 23. The output of each sensor element 25 is, in turn, effectively connected to an instructor station 27 which includes a microprocessor computer 29, FIG. 2. Microprocessor computer 29, FIG. 2, as will be discussed in detail below, is programmed so as to indicate to a particular trainee rifleman 9 and an instructor 31 whether or not trainee rifleman 9 has scored a hit upon visual target 19.

Figure 2:
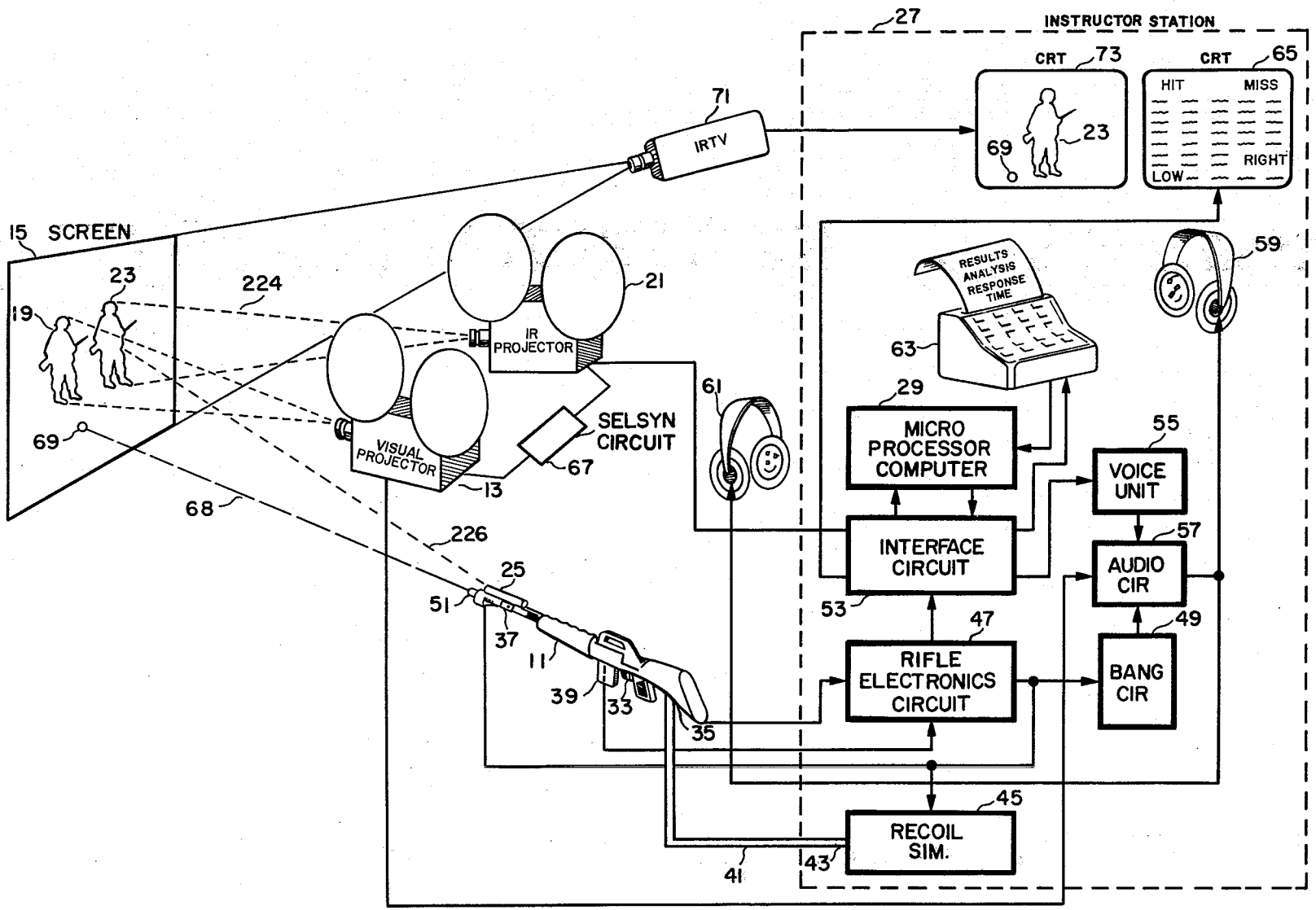
FIG. 2 is a schematic diagram of the system constituting the invention of FIG. 1.

Referring now to FIG. 2, there is shown a diagrammatical representation of the subject invention including weapon 11. Because all of the five weapons 11, 12, 14, 16, and 18, FIG. 1, operate in exactly the same manner, and for the sake of keeping this disclosure as simple as possible, only one thereof will be described.

Weapon 11, as discussed previously, has attached to the barrel thereof a sensor element 25, the outputs of which are connected to the signal inputs of a rifle electronics circuit 47. Weapon 11 also includes a trigger mechanism 33, an intake port 35, an orifice 37 located near the tip of the barrel of weapon 11, and an ammunition magazine 39 engagably attached to weapon 11 so as to allow ammunition magazine 39 to be removed from weapon 11. Intake port 35 of weapon 11 is connected by a hose 41 to an output port 43 of a rifle recoil simulator 45.

At this time it may be noted that for a complete description of rifle recoil simulator 45, reference is hereby made to the United States patent application entitled Rifle Recoil Simulator by Bon F. Shaw and Albert H. Marshall, Ser. No. 105,176 filed Dec. 19, 1979 now U.S. Pat. No. 4,302,190 issued Nov. 24, 1981, filed concurrently with this application.

The output of ammunition magazine 39 is connected to the clip input of rifle electronics circuit 47, which the trigger output thereof effectively connected to the inputs of rifle recoil simulator 45, a bang circuit 49, and a laser 51 which is attached to the barrel of weapon 11.

At this time it may be noted that for a complete description of a circuit which may be utilized as bang circuit 49, reference is hereby made to a publication entitled M-16 Gun Soundburst Synthesizer, by John C. McKechnie and Bon F. Shaw, appearing in Navy Technical Disclosure Bulletin, Vol. IV, No. 7, page 31, July 1979.

Also, it may be noted that a Programmable Sound Generator, Model No. AY-3-8910, manufactured by General Instrument Corporation may be utilized as bang circuit 49.

The data outputs of rifle electronics circuit 47 are connected to the data inputs of an interface circuit 53, the data outputs of which are connected to the data inputs of microprocessor computer 29. Similarly, the serial data output of microprocessor computer 29 is effectively connected to the serial data input of interface circuit 53.

Microprocessor computer 29 may be any conventional microprocessor computer and is commercially available from several different sources. In particular, it has been found that a microprocessor computer Model SYS-80/204, manufactured by Intel Inc., of Santa Clara, Calif., performs quite satisfactorily as microprocessor computer 29.

The voice unit enable output of interface circuit 53 is connected to a voice unit 55, the output of which is connected to the second input of an audio circuit 57, with the output thereof effectively connected to a pair of headphones 59 and 61. The third input of audio circuit 57 is connected to the output of bang circuit 49, and the first input of audio circuit 57 is connected to the second output of visual projector 13.

Voice unit 55 may be any conventional computer voice system and is commercially available from several different sources. In particular, it has been found that a computer voice system Model LVM-70 manufactured by Votrax of Troy, Mich., performs quite satisfactorily as voice unit 55.

The data terminal enable output of interface circuit 53 is connected to the input of a data terminal 63, with the output thereof connected to the data terminal input of microprocessor computer 29. The CRT output of interface circuit 53 is connected to the input of a data CRT display 65.

The target present input of interface circuit 53 is connected to the second output of infrared projector 21, and the target present output of interface circuit 53 is connected to the target present input of microprocessor computer 29. Effectively connected between the first infrared projector 21 and visual projector 13 is a selsyn circuit 67.

Laser 51 which, as mentioned above, is attached to the barrel of weapon 11, projects onto screen 15 a laser beam spot 69. An infrared television camera 71, which is spatially disposed downstream from screen 15, is adapted for scanning laser beam spot 69 and infrared target 23. The output of infrared television camera 71 is effectively connected to the input of an infrared target CRT display 73.

As mentioned previously, visual projector 13 projects onto screen 15 visual target 19, and infrared projector 21 simultaneously projects onto screen 15 infrared target 23.

Also of note is that located within instructor station 27 are microprocessor computer 29, recoil simulator 45, rifle electronics circuit 47, bang circuit 49, interface circuit 53, voice unit 55, and audio circuit 57. Mounted upon instructor station 27 are headphone 59, data terminal 63, data CRT display 65, and infrared spot CRT display 73.

Figure 3:
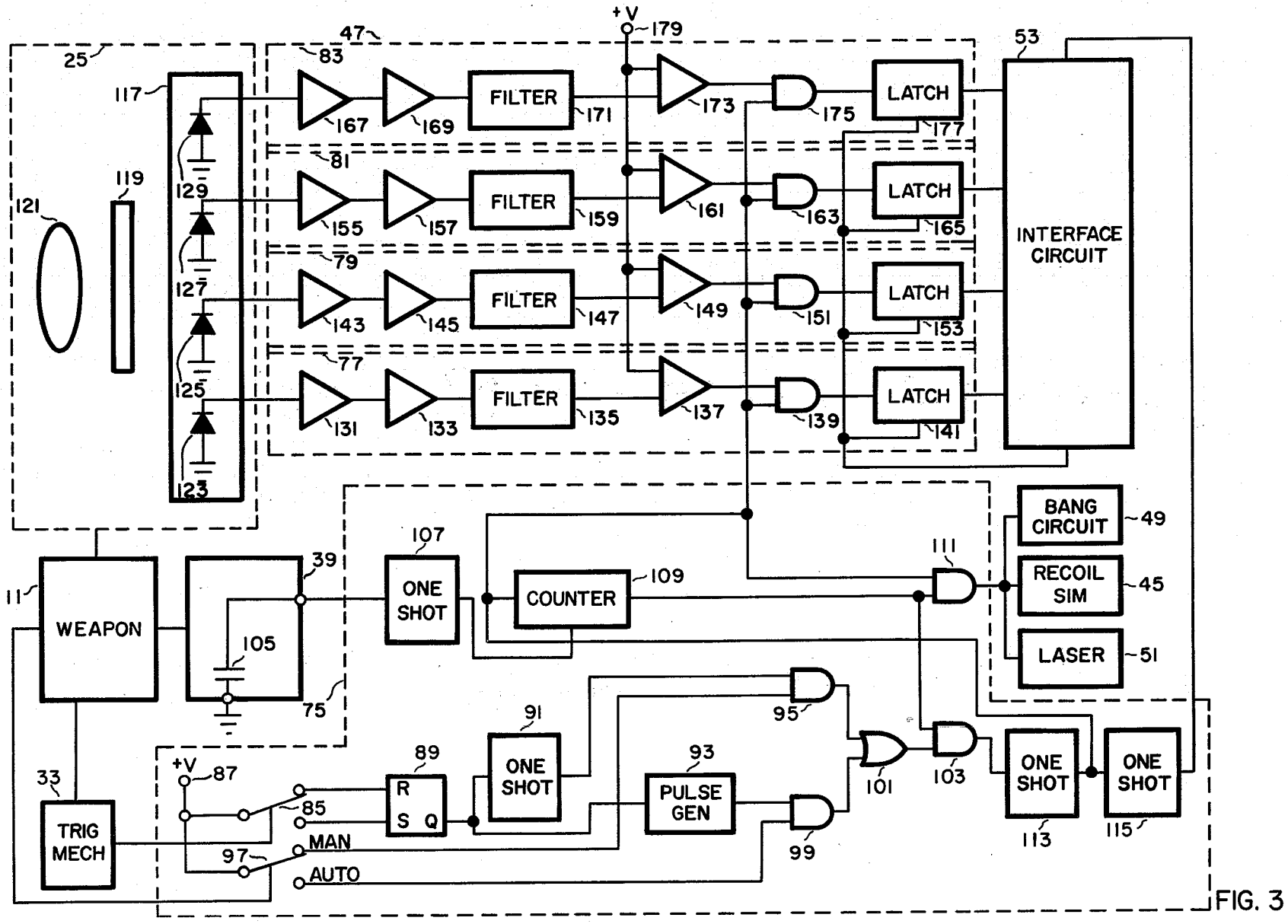
FIG. 3 is a circuit diagram of the rifle electronics circuit shown in block form in FIG. 2.

Referring now to FIG. 3, there is shown a schematic diagram of rifle electronics circuit 47 which includes an enable circuit 75, the enable output of which is connected to the enable inputs of a quartet of sensor circuits 77, 79, 81, and 83. The data ready output of enable circuit 75 is connected to the data ready input of interface circuit 53, and the trigger output of enable circuit 75 is connected to the inputs of recoil simulator 45, bang circuit 49, and laser 51.

Enable circuit 75 comprises a trigger switch 85 mechanically coupled to trigger mechanism 33 of weapon 11. The input of trigger switch 85 is connected to a voltage source 87, with the first output thereof connected to the reset input of an RS filp-flop 89, and the second output thereof connected to the set input of RS flip-flop 89. The Q output of RS flip-flop 89 is connected to the input of a one-shot multivibrator 91, and the input of a pulse generator 93. The output of one-shot multivibrator 91 is connected to the first input of an AND gate 95.

The input of an auto-manual switch 97, mounted upon weapon 11, is connected to voltage source 87, with the manual output thereof connected to the second input of AND gate 95, and the auto output thereof connected to the first input of an AND gate 99. The output of pulse generator 93 is connected to the second input of AND gate 99, the output of which is connected to the first input of an OR gate 101. The output of AND gate 95 is connected to the second input of OR gate 101. The output of OR gate 101 is connected to the first input of an AND gate 103.

A capacitor 105 mounted within ammunition magazine 39 is connected to a one-shot multivibrator 107, the output of which is connected to the reset input of a counter 109, with the output thereof connected to the first input of an AND gate 111 and the second input of AND gate 103.

The output of AND gate 103 is connected to the input of a one-shot multivibrator 113, the output of which is connected to the input of a one-shot multivibrator 115, the clock input of counter 109, the second input of AND gate 111, and the enable inputs of sensor circuits 77, 79, 81, and 83. The output of one-shot multivibrator 115 is connected to the data ready strobe input of interface circuit 53. The output of AND gate 111 is connected to the inputs of recoil simulator 45, bang circuit 49, and laser 51.

Sensor element 25, which as mentioned above is attached to the barrel of weapon 11, comprises a quadrant detector 117, an optical filter 119 disposed in front of quadrant detector 117, and a focusing lens 121 disposed in front of optical filter 119. Quadrant detector 117 includes four photodiodes 123, 125, 127, and 129, the respective outputs of which are connected to the signal inputs of sensor circuits 77, 79, 81, and 83.

The output of photodiode 123 is connected to the input of an amplifier 131, the output of which is connected to the input of an amplifier 133, with the output thereof connected to the input of an active filter 135. The output of active filter 135 is connected to the first input of a comparator 137, the output of which is connected to the first input of an AND gate 139, with the output thereof connected to the first input of a latch 141.

The output of photodiode 125 is connected to the input of an amplifier 143, the output of which is connected to the input of an amplifier 145, with the output thereof connected to the input of an active filter 147. The output of active filter 147 is connected to the first input of a comparator 149, the output of which is connected to the first input of an AND gate 151, with the output thereof connected to the first input of a latch 153.

The output of photodiode 127 is connected to the input of an amplifier 155, the output of which is connected to the input of an amplifier 157, with the output thereof connected to the input of an active filter 159. The output of active filter 159 is connected to the first input of a comparator 161, the output of which is connected to the first input of an AND gate 163, with the output thereof connected to the first input of a latch 165.

The output of photodiode 129 is connected to the input of an amplifier 167, the output of which is connected to the input of an amplifier 169, with the output thereof connected to an active filter 171. The output of active filter 171 is connected to the first input of a comparator 173, the output of which is connected to the first input of an AND gate 175, with the output thereof connected to the first input of a latch 177.

The respective outputs of latches 141, 153, 165, and 177 are connected to the data inputs of interface circuit 53. A direct current voltage source 179 is connected to the second input of comparators 137, 149, 161, and 173. The enable output of enable circuit 75 is connected to the second input of AND gates 139, 151, 163, and 175. In addition, the reset output of interface circuit 53 is connected to the reset input of latches 141, 153, 165, and 177.

At this time it may be noted that active filters 135, 147, 159, and 171 pass only a frequency of ninety-six hertz, and may be a Model UAF-41, manufactured by Burr Brown, Inc., of Tucson, Ariz.

Figure 4:
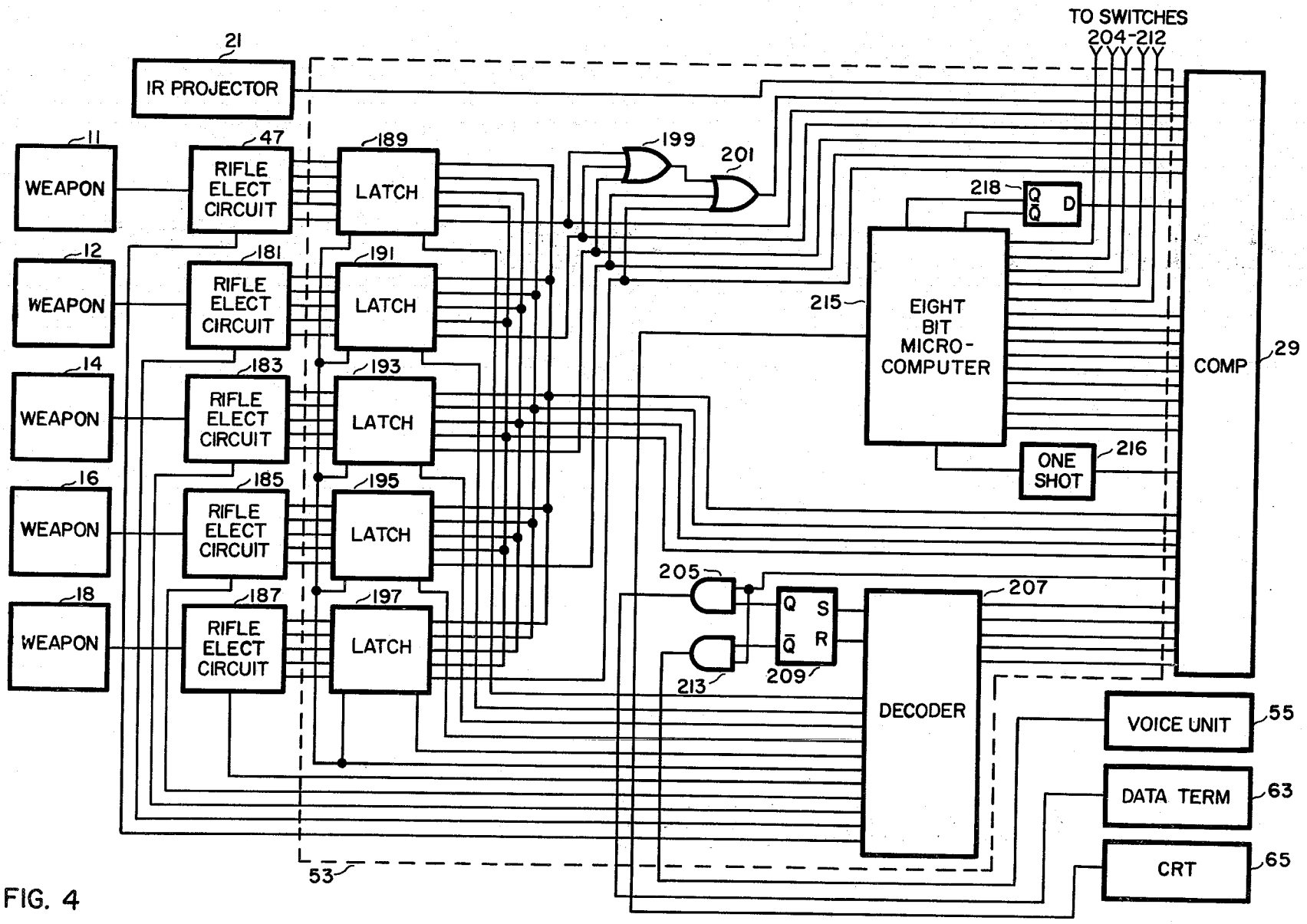
FIG. 4 is a circuit diagram of the interface circuit shown in block form in FIG. 2.

Referring to FIG. 4, there is shown five weapons 11, 12, 14, 16, and 18 respectively connected to the inputs of five rifle electronics circuits 47, 181, 183, 185, and 187. Although rifle electronics circuits 181, 183, 185, and 187 function in exactly the same manner as the aforementioned rifle electronics circuit 47, for the sake of clarity in describing the subject invention, the aforementioned rifle electronics circuits have been assigned separate numbers.

Interface circuit 53 includes five latches 189, 191, 193, 195, and 197. The four data outputs of rifle electronics circuit 47 are respectively connected to the four data inputs of latch 189, with the four data outputs thereof respectively connected to the four data inputs of microprocessor computer 29.

The four data outputs of rifle electronics circuit 181 are respectively connected to the four data inputs of latch 191, the four data outputs of which are respectively connected to the four data inputs of microprocessor computer 29.

The four data outputs of rifle electronics circuit 183 are respectively connected to the four data inputs of latch 193, with the four data outputs thereof respectively connected to the four data inputs of microprocessor computer 29.

The four data outputs of rifle electronics circuit 185 are respectively connected to the four data inputs of latch 195, with the four data outputs thereof respectively connected to the four data inputs of microprocessor computer 29.

The four data outputs of rifle electronics circuit 187 are respectively connected to the four data inputs of latch 197, the four data outputs of which are respectively connected to the four data inputs of microprocessor computer 29.

The data strobe ready outputs of rifle electronics circuits 47, 181, 183, 185, and 187 are respectively connected to the data strobe ready inputs of latches 189, 191, 193, 195, and 197.

The interrupt outputs of latches 189, 191, and 193 are respectively connected to the three inputs of an OR gate 199, the output of which is connected to the first input of an OR gate 201, with the output thereof connected to the master service request input of microprocessor computer 29. The interrupt outputs of latches 195 and 197 are respectively connected to the second and third inputs of OR gate 201. The interrupt outputs of latches 189 through 197 are respectively connected to the five service request inputs of microprocessor computer 29.

At this time it may be noted that each of latches 189 through 197 may be an Eight-Bit Input/Output Port, Model 8212, manufactured by Intel, Inc., of Santa Clara, Calif.

The serial data output of microprocessor computer 29 is connected to the first input of AND gate 205 and the first input of AND gate 213.

The four decode select outputs of microprocessor computer 29 are respectively connected to the four decode select inputs of a decoder 207, and the decode enable output of microprocessor computer 29 is connected to the decode enable input of decoder 207.

The first control output of decoder 207 is connected to the set input of an RS flip-flop 209, the Q output of which is connected to the second input of AND gate 205. The output of AND gate 205 is connected to the input of data terminal 63.

The second control output of decoder 207 is connected to the reset input of RS flip-flop 209, with the $\overline{Q}$ output thereof connected to the second input of AND gate 213, the output of which is connected to the input of voice unit 55.

The five data ready outputs of decoder 207 are respectively connected to the data ready inputs of latches 189 through 197. The data clear output of decoder 207 is connected to the data clear inputs of latches 189 through 197. The five reset outputs of decoder 207 are respectively connected to the reset inputs of rifle electronics circuits 47, 181, 183, 185, and 187.

It may be noteworthy to mention that decoder 207 may be a 1 of 16 decoder, Model 9311, manufactured by Fairchild, Inc., of Mountain View, Calif.

The four rifle data outputs of microprocessor computer 29 are respectively connected to the four rifle data inputs of an eight-bit microcomputer 215, the output of which is connected to the input of data CRT display 65.

The three rifle select outputs of microprocessor computer 29 are respectively connected to the three rifle select inputs of eight-bit microcomputer 215. The initialization output of microprocessor computer 29 is connected to the initialization input of eight-bit microcomputer 215.

The write output of microprocessor computer 29 is connected to the input of a one-shot multivibrator 216, the output of which is connected to the write input of eight-bit microcomputer 215. The clock output of microprocessor computer 29 is connected to the D input of a D flip-flop 218, with the Q output thereof connected to the X1 input of eight-bit microcomputer 215 and the $\overline{Q}$ output thereof connected to the X2 input of eight-bit microcomputer 215.

Figure 15:
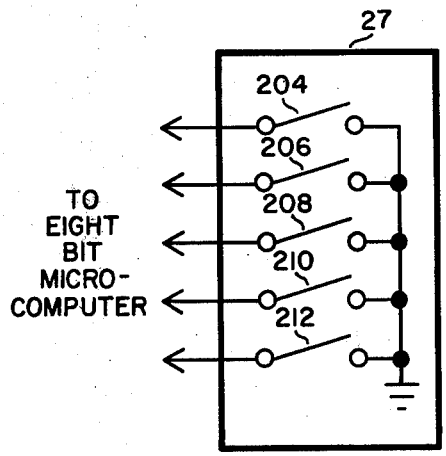
FIG. 15 is a circuit diagram of the control switches on the instructor station of FIG. 2.

The inputs of a quintet of control switches 204, 206, 208, 210, and 212, FIG. 15, which are mounted upon instructor station 27, FIG. 15, are connected to ground. The outputs of control switches 204, 206, 208, 210, and 212, FIG. 15, are respectively connected to the switch control inputs of eight-bit microcomputer 215.

The second output of infrared projector 21 is connected to the target present input of interface circuit 53, with the target present output thereof connected to the target present input of microprocessor computer 29.

It may be noteworthy to mention that eight-bit microcomputer 215 is a Universal Peripheral Interface Eight-Bit Microcomputer, Model 8741, manufactured by Intel, Inc., of Santa Clara, Calif.

Figure 5:
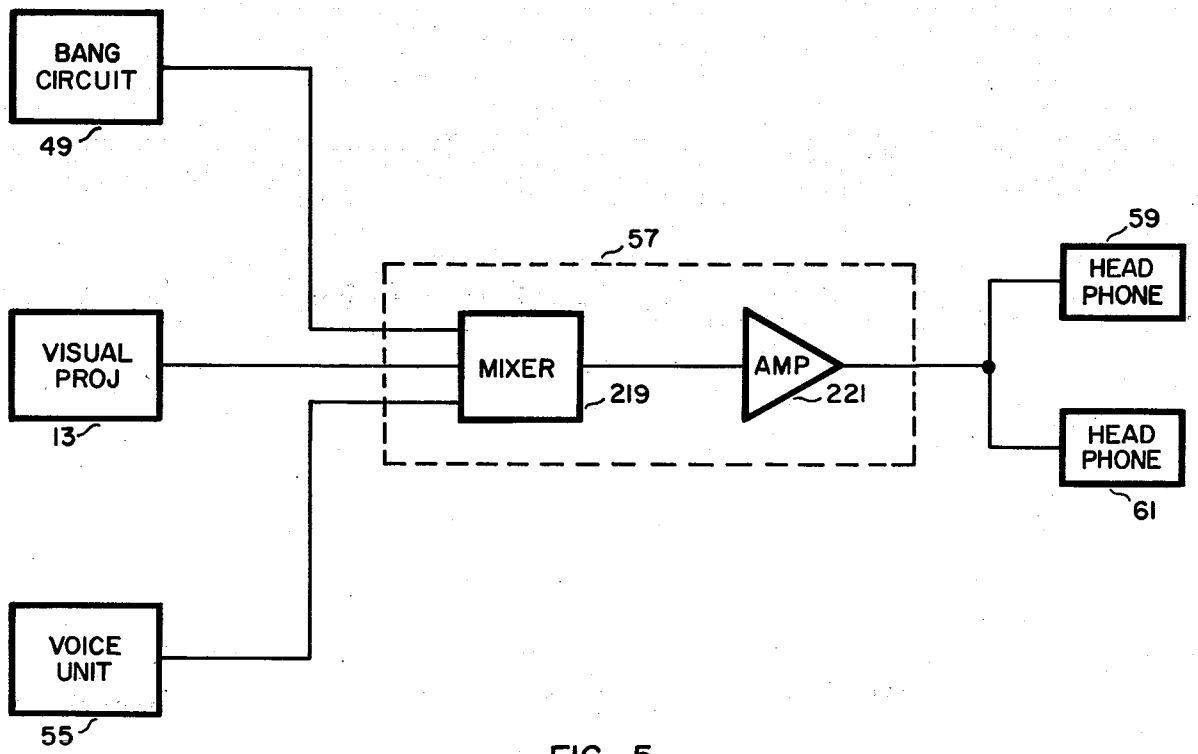
FIG. 5 is a circuit diagram of the audio circuit shown in block form in FIG. 2.

Referring now to FIG. 5, there is shown audio circuit 57 which includes a mixer 219, the first input of which is connected to the second input of visual projector 13, the second input of which is connected to the output of voice unit 55, and the third input of which is connected to the output of bang circuit 49. The output of mixer 219 is connected to an amplifier 221, with the output thereof connected to the inputs of headphones 59 and 61.

Figure 6:
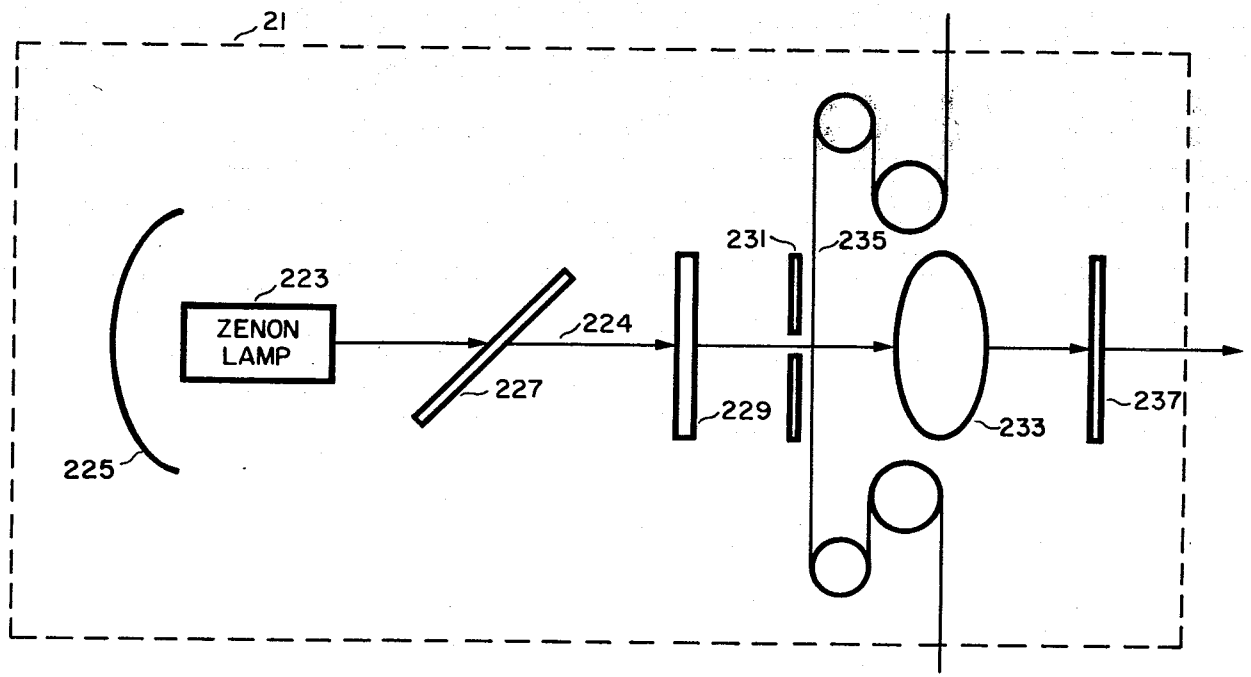
FIG. 6 is a schematic diagram of the infrared projector of FIG. 2.
Figure 7:
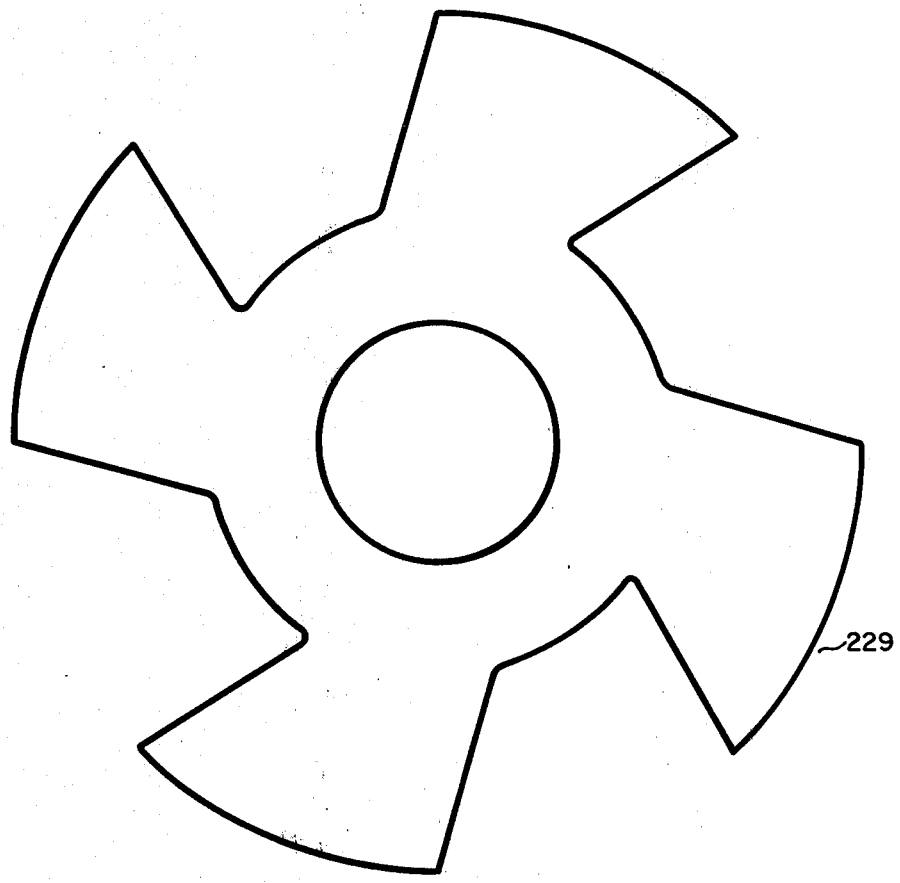
FIG. 7 is a schematic diagram of the four blade chopper shown in FIG. 6.

Referring now to FIG. 6, there is shown infrared projector 21 which includes a zenon lamp 223 for generating an infrared light beam 224. Positioned directly behind zenon lamp 223 is a reflector 225. Disposed in front of zenon lamp 223 is a cold mirror 227. Disposed directly in front of cold mirror 227 is a four blade shutter 229, which is also illustrated in FIG. 7. Four blade shutter 229, as will be discussed in more detail below, is designed so as to chop infrared target 23, FIG. 2, at a frequency of ninety-six hertz.

Disposed in front of four blade shutter 229 is an aperture 231. Positioned in front of aperture 231 is a lens 233. Passing between aperture 231 and lens 233 is a set of film frames 235 which have infrared target 23, FIG. 2, printed thereon. A black glass element 237 is positioned in front of lens 233.

At this time it may be noteworthy to mention that visual projector 13, infrared projector 21, and selsyn circuit 67 are a commercially available projector system, Model X-500 H, manufactured by Rangertone Research Corp. of Newark, N.J. As noted above, infrared projector 21 has been modified to include four blade shutter 229 so as to chop infrared target 23, FIG. 2, at a frequency of ninety-six hertz.

Figure 8:
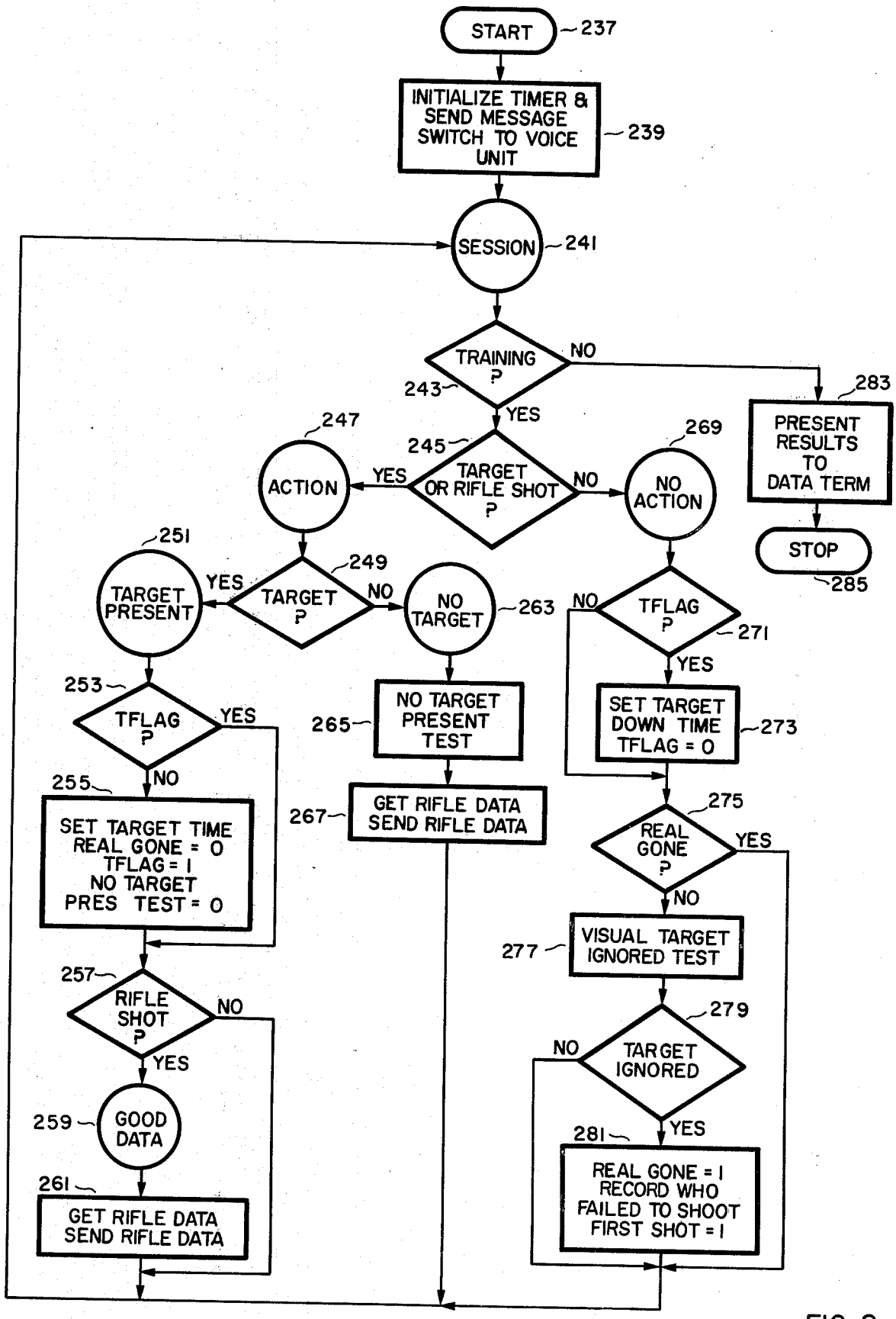
FIG. 8 is a flow chart of a computer program used by the microprocessor computer of FIG. 2.

Referring to FIG. 8, there is shown a flow chart of a computer program utilized by microprocessor computer 29, FIG. 2, to determine hits, specific areas of near miss, and total misses for each of the five trainee riflemen 9, FIG. 1, firing weapons 11, 12, 14, 16, or 18, FIG. 1, at infrared target 23, FIG. 1. The details of the operation of the aforementioned computer program will be discussed more fully below.

Referring to FIG. 9, there is shown a truth table which, when utilized in a computer program, will determine whether trainee rifleman 9, FIG. 1, upon firing weapon 11, FIG. 1, has either hit or missed infrared target 23, FIG. 1.

Figure 10:
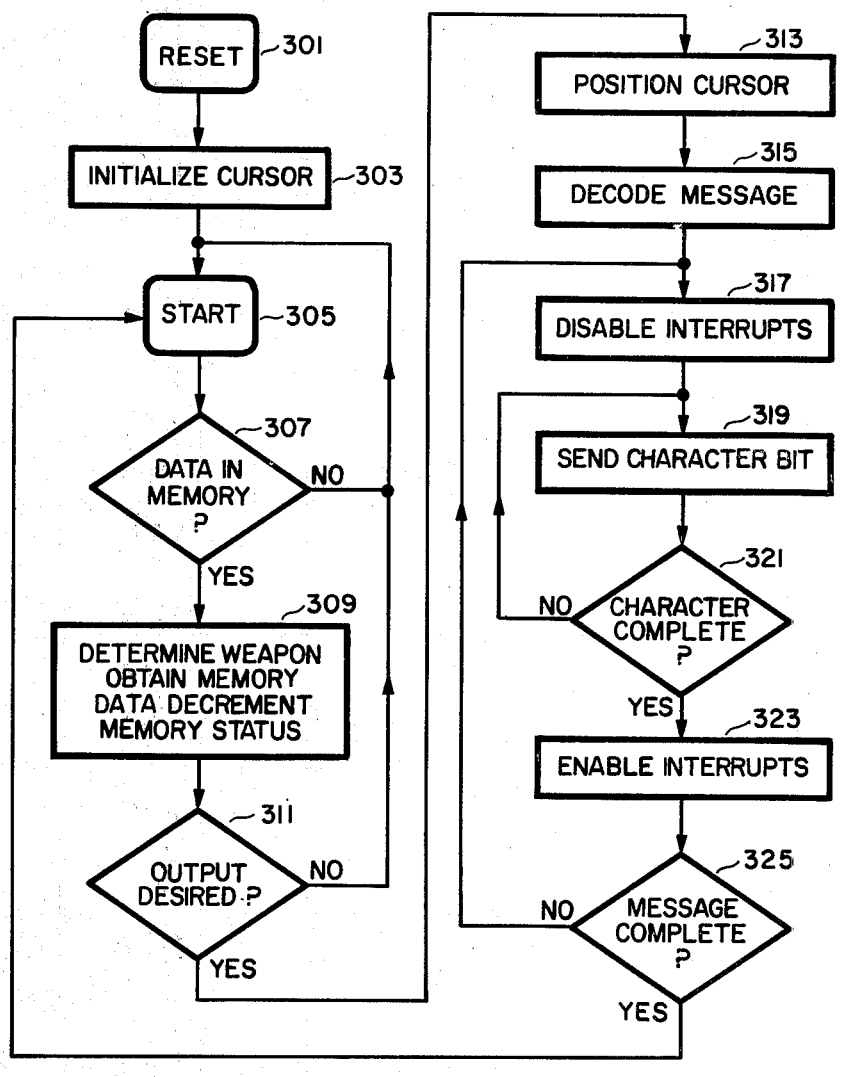
FIG. 10 is the first of a pair of flow charts of a computer program used by the eight-bit microcomputer of FIG. 4.
Figure 11:
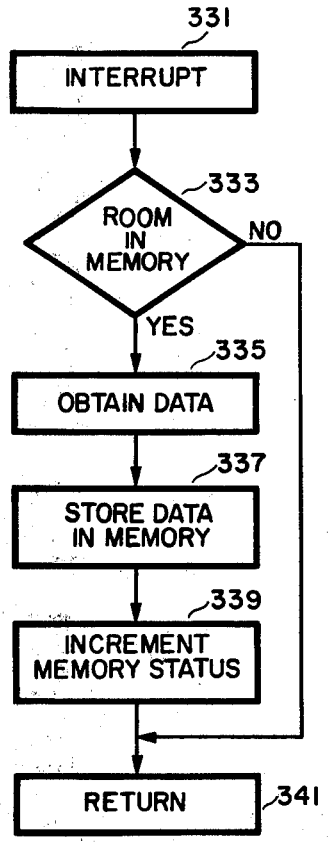
FIG. 11 is the second of the pair of flow charts of the computer program used by the eight-bit microcomputer of FIG. 4.

Referring to FIGS. 10 and 11, there is shown a pair of flow charts of a computer program utilized by eight-bit microcomputer 215, FIG. 4, to determine hits an specific areas of near miss for each of the five trainee riflemen 9, FIG. 1 firing weapons 11, 12, 14, 16, or 18, FIG. 1, at infrared target 23, FIG. 1. The details of the operation of the aforementioned computer program will be discussed more fully below.

MODE OF OPERATION

The operation of the subject invention will now be discussed in conjunction with all the figures of the drawings.

Referring first to FIGS. 1 and 2, there is shown five trainee riflemen 9, each of whom is holding and firing weapons 11, 12, 14, 16, or 18 at visual target 19. The five trainee riflemen 9 are able to visualize background scene 17, including visual target 19, but are unable to discern infrared target 23 which represents the aiming point for proper lead in aiming weapons 11, 12, 14, 16, or 18. Each trainee rifleman 9, to score a hit upon visual target 19, must properly aim weapon 11, 12, 14, 16, or 18 at infrared target 23. Thus, for example, if visual target 19 is to the left of infrared target 23 on screen 15, this indicates that visual target 19 is moving to the right, requiring each trainee rifleman 9 to aim to the right of visual target 19 to score a hit thereon.

Because the subject invention operates in exactly the same manner with respect to each of the five weapons 11, 12, 14, 16, and 18, and for the sake of keeping this disclosure as simple as possible, the operation of the subject invention will be described with respect to only weapon 11.

Referring now to FIGS. 2, 6, and 7, there is shown visual projector 13, which projects onto screen 15 background scene 17 including visual target 19. Background scene 17 including visual target 19 is chopped at a frequency of forty-eight hertz by visual projector 13.

Infrared projector 21 projects onto screen 15 infrared target 23. Infrared projector 21, as discussed previously, has been modified so as to include four blade shutter 229 between cold mirror 227 and aperture 231. Infrared light beam 224 emitted by zenon lamp 223 is chopped by four blade shutter 229 at a frequency of ninety-six hertz. Chopped infrared light beam 224 is, in turn, passed through the set of film frames 235, which have infrared target 23 printed thereon, and then projected onto screen 15. This results in infrared target 23 appearing on screen 15 at a frequency of ninety-six hertz.

Selsyn circuit 67 coordinates the film frame drives of visual projector 13 and infrared projector 21 so as to provide the necessary lead for infrared target 23 such that when trainee rifleman 9, FIG. 1, correctly aims weapon 11 at infrared target 23, a hit will be recorded on visual target 19.

Referring to FIGS. 2 and 3, focusing lens 121 and optical filter 119 are provided to pass only an infrared light beam 226 from infrared target 23 to quadrant detector 117. Focusing lens 121 concentrates infrared light beam 226 into a small substantially point-like spot. Optical filter 119 is employed to delete from infrared light beam 226 any spurious radiant energy, such as bright sunlight and glare.

As quadrant detector 117 receives infrared light beam 226 from infrared target 23, one or more of the quartet of photodiodes 123, 125, 127, and 129 are activated thereby depending upon the aiming accuracy of trainee rifleman 9, FIG. 1. For example, if there were a hit upon visual target 19 by trainee rifleman 9, all four photodiodes 123, 125, 127, and 129 would be activated and then produce analog output signals at the outputs thereof, and if the aim of trainee rifleman 9, FIG. 1, when firing weapon 11 were high and to the right, then only photodiode 125 would be activated. Depending upon which photodiodes were activated, sensor circuits 77, 79, 81, and/or 83 would be activated in correspondence thereto.

Because all of the aforementioned sensor circuits operate in exactly the same manner, and for the sake of keeping this disclosure as simple as possible, it may be assumed that trainee rifleman 9, FIG. 1, has aimed and fired weapon 11 high and to the left, thereby activating photodiode 123 and the associated sensor circuit 77.

The analog output signal from photodiode 123 is amplified to a more useful voltage level by amplifiers 131 and 133 before it is supplied to the input of active filter 135 which has a center frequency of ninety-six hertz and passes only this frequency.

At this time it may be noted that the center frequency of active filter 135 is identical to the frequency at which infrared target 23 is being chopped by infrared projector 21. This allows sensor element 25 to ignore all spurious radiant energy and pass to microprocessor computer 29 only target information from infrared target 23.

The output signal from active filter 135, which is a sine wave having a frequency of ninety-six hertz, is then supplied to the first input of comparator 137 for comparison with direct current voltage source 179, the voltage level of which has been selected to set a desired threshold level before being enabled. Thus it may be seen that comparator 137 acts as a thresholder which effectively prevents the processing of photodiode signals that are less than the voltage level provided by direct current voltage source 179. Such thresholding prevents spurious or relatively low light conditions from enabling the subject invention, and thus give a false reading.

When the input signal to comparator 137 exceeds the voltage level provided by direct current voltage source 179, a pulse occurs at the output thereof. An enable pulse generated by enable circuit 75 whenever trainee rifleman 9, FIG. 1, fires weapon 11, the details of which will be discussed more fully below, allows the pulse provided by comparator 137 through AND gate 139 to the first input of latch 141. This pulse triggers latch 141 from an inactive "0" state to an active "1" state, causing a digital logic data signal to appear at the output of latch 141. Hence, as best seen in the truth table of FIG. 9, when trainee rifleman 9, FIG. 1, aims and fires weapon 11 high and to the left, a 1,0,0,0 data word will appear at the data outputs of the four sensor circuits 77, 79, 81, and 83.

As mentioned previously, whenever trainee rifleman 9, FIG. 1, fires weapon 11, enable circuit 75 generates the enable pulse which allows the reading out of the data word appearing at the data outputs of sensor circuits 77, 79, 81, and 83. When trainee rifleman 9, FIG. 1, activates trigger mechanism 33 by firing weapon 11, trigger switch 85 activates the set input of RS flip-flop 89, causing the Q output thereof to change from an inactive "0" state to an active "1" state. Similarly, when trainee rifleman 9, FIG. 1, releases trigger mechanism 33, trigger switch 85 activates the reset input of RS flip-flop 89, causing the Q output thereof to change from an active "1" state to an inactive "0" state. Thus, appearing at the Q output of RS flip-flop 89 is a pulse, the duration of which depends upon the length of time trainee rifleman 9, FIG. 1, activates trigger mechanism 33.

The pulse provided by RS flip-flop 89 is supplied to the input of one-shot multivibrator 91 which produces a pulse at the output thereof, and to the input of pulse generator 93. When the Q output of RS flip-flop 89 is in the active "1" state, pulse generator 93 produces a pulse signal, having a plurality of pulses, the frequency of which is twelve hertz.

Depending upon the mode of auto-manual switch 97, either the pulse provided by one-shot multivibrator 91, or the pulse signal provided by pulse generator 93 will appear at the output of OR gate 101. Thus, when auto-manual switch 97 is in the manual mode, voltage source 87 supplies to the second input of AND gate 95 a logic "1" signal so as to allow the pulse provided by one-shot multivibrator 91 through AND gate 95 and OR gate 101 to the first input of AND gate 103.

Similarly, when auto-manual switch 97 is in the auto mode, voltage source 87 supplies the second input of AND gate 99 a logic "1" signal so as to allow the pulse signal provided by pulse generator 93 through AND gate 99 and OR gate 101 to the first input of AND gate 103.

For the sake of keeping this disclosure as simple as possible and because the subject invention operates in the same way in the manual mode as in the automatic mode, the subject invention will be described in the manual mode only.

Ammunition magazine 39, as mentioned above, may be removed from weapon 11 so as to allow capacitor 105 to be charged to a predetermined voltage level. Ammunition magazine 39 may then be reinserted in weapon 11, thereby causing capacitor 105 to activate one-shot multivibrator 107 which provides a pulse at the output thereof. The pulse provided by one-shot multivibrator 107 is supplied to the reset input of counter 109, causing the output of counter 109 to change from an inactive "0" state to an active "1" state. This, in turn, allows the pulse provided by one-shot multivibrator 91 through AND gate 103 to the input of one-shot multivibrator 113 so as to produce at the output thereof the aforementioned enable pulse.

As previously discussed, the enable pulse provided by one-shot multivibrator 113 allows the pulse provided by comparator 137 through AND gate 139 to latch 141 so as to trigger latch 141, and thereby cause to appear at the data outputs of sensor circuits 77, 79, 81, and 83 the 1,0,0,0 data word.

Each time trainee rifleman 9, FIG. 1, fires weapon 11, the enable pulse provided by one-shot multivibrator 113 is also supplied to the clock input of counter 109 so as to increment counter 109 by a counter of one. Counter 109 is set at a predetermined count of thirty, such that when trainee rifleman 9, FIG. 1, fires weapon 11 thirty times, the output of counter 109 changes from an active "1" state to an inactive "0" state. This, in turn, inhibits AND gate 103, thereby preventing one-shot multivibrator 113 from producing an enable pulse whenever trainee rifleman 9, FIG. 1, fires weapon 11. Thus, for a data word to appear at the data outputs of sensor circuits 77, 79, 81, and 83, ammunition magazine 39 must be removed from weapon 11, capacitor 105 must be charged by a charging source, not shown, and ammunition magazine 39 must be reinserted in weapon 11 so as to reset the output of counter 109 to the active "1" state.

The enable pulse provided by one-shot multivibrator 113 is supplied to the input of one-shot multivibrator 115 so as to cause one-shot multivibrator 115 to produce at the output thereof a data ready pulse which is supplied to the data ready input of interface circuit 53. The aforementioned enable pulse is also supplied to the second input of gate 111 so as to provide at the output thereof a trigger pulse. The trigger pulse is then supplied to the inputs of bang circuit 49, recoil simulator 45, and laser 51 whenever the output of counter 109 is in the active "1" state.

Referring to FIGS. 2, 3, and 5, upon receiving the trigger pulse from enable circuit 75, bang circuit 49 generates an audio signal which is supplied to the third input of mixer 219. Mixer 219, in turn, passes the audio signal therethrough to the input of amplifier 221 which amplifies the audio signal. The audio signal is then supplied to the inputs of headphones 59 and 61 which provide a "bang" sound whenever trainee rifleman 9, FIG. 1, fires weapon 11.

As mentioned above, for a complete description of the operation of bang circuit 49, reference is again made to the publication entitled M-16 Gun Soundburst Synthesizer by John C. McKechnie and Bon F. Shaw, appearing in Navy Technical Disclosure Bulletin, Vol. IV, No. 7, page 31, July 1979.

Upon receiving the trigger pulse from enable circuit 75, recoil simulator 45 provides a stream of compressed air which passes from output port 43 through hose 41 to intake port 35 of weapon 11. The stream of compressed air then exits through orifice 37, forcing the barrel of weapon 11 up and to the right. Thus, whenever trainee rifleman 9, FIG. 1, fires weapon 11, a simulated recoil force is applied to the barrel of weapon 11.

As mentioned above, for a complete description of the operation of recoil simulator 45, reference is again made to the United States Patent Application entitled Rifle Recoil Simulator, by Bon F. Shaw and Albert H. Marshal, Ser. No. 105,176 filed Dec. 19, 1979, now U.S. Pat. No. 4,302,190, Issued Nov. 24, 1981, filed concurrently with this application.

Upon receiving the trigger pulse provided by enable circuit 75, laser 51 projects laser beam spot 69 onto screen 15. Infrared television camera 71, which scans screen 15, will sense laser beam spot 69 and infrared target 23, thereby causing laser beam spot 69 and infrared target 23 to appear upon infrared target CRT display 73.

Referring now to FIGS. 3 and 4, the digital logic data signals appearing at the data outputs of sensor circuits 77, 79, 81, and 83 are stored by latch 189 when latch 189 receives the data ready pulse from enable circuit 75 of rifle electronics circuit 47. Thus, the 1,0,0,0 data word appearing at the data outputs of sensor circuits 77, 79, 81, and 83 will be stored by latch 189.

As mentioned above, the subject invention is being described with respect to only one of the five weapons. Accordingly, for the purpose of describing the operation of interface circuit 53, only latch 189 will have data stored therein.

Upon receiving the data ready pulse from enable circuit 75 of rifle electronics circuit 47, latch 189 produces at the interrupt output thereof an interrupt signal which has an active "1" state. The interrupt signal is then passed through OR gates 199 and 201 to the master service request input of microprocessor computer 29, thereby indicating to microprocessor computer 29 that at least one of the five latches 189, 191, 193, 195, and/or 197 has a data word stored therein. Microprocessor computer 29 then scans the five service request inputs thereof to determine which of the five latches 189, 191, 193, 195, and/or 197 have data words stored therein. For example, since the interrupt output of latch 191 is in the active "1" state, microprocessor computer 29 is able to determine that latch 189 has the 1,0,0,0 data word stored therein.

Since microprocessor computer 29 has determined that latch 189 has a data word stored therein, microprocessor computer 29 will supply to the decode select input of decoder 207 a 0,0,0,1 address word in accordance with the truth table of FIG. 12. Microprocessor computer 29 will simultaneously supply a decode enable pulse, which activates decoder 207, to the decode enable input of decoder 207. This, in turn, causes decoder 207 to supply to the data ready input of latch 189 a data ready pulse. Latch 189 will then supply the 1,0,0,0 data word stored therein to the data input of microprocessor computer 29, and the interrupt output of latch 189 returns to inactive "0" state. Microprocessor computer 29 processes the aforementioned data word in accordance with the truth table of FIG. 9, so as to determine whether trainee rifleman 9, FIG. 1, has recorded a hit or a miss upon visual target 19, FIG. 1.

Microprocessor computer 29, upon receiving the 1,0,0,0 data word from latch 189, supplies to decoder 207 in accordance with the truth table of FIG. 12, a 0,1,1,0 address word and a decode enable pulse. Decoder 207 then supplies to the reset input of rifle electronics circuit 47 a reset pulse. The reset pulse provided by decoder 207 resets latches 141, 153, 165, and 177 of rifle electronics circuit 47, thereby allowing a different data word to be stored therein.

At this time it may be noted that so long as the master service request input of microprocessor computer 29 is in the active "1" state, microprocessor computer 29 will continue to scan the interrupt outputs of latches 189 through 197. Thus, for example, if after receiving the 1,0,0,0 data word from latch 189, microprocessor computer 29 determined that the interrupt output of latch 191 is in an active "1" state, microprocessor computer 29 will supply to decoder 207 a 0,0,1,0 address word in accordance with the truth table of FIG. 12, and a decode enable pulse. Decoder 207 then supplies a data ready pulse to the data ready input of latch 191, thereby causing latch 191 to supply the data word stored therein to the data inputs of microprocessor computer 29.

At this time it may also be noted that microprocessor computer 29 also supplies a 1,0,1,1 address word, in accordance with the truth table of FIG. 12, and a decode enable pulse to decoder 207 during a start up of the subject invention. Decoder 207 then supplies to the data clear inputs of latches 189 through 197 a data clear pulse which activates latches 187 through 197, thereby allowing latches 187 through 197 to store the data words provided by rifle electronics circuits 47, 181, 183, 185, and 187.

Upon completion of the analysis by microprocessor computer 29 of the 1,0,0,0 data word received from latch 189, microprocessor computer 29 will supply to decoder 207 a 1,1,0,0 address word in accordance with the truth table of FIG. 12, and a decode enable pulse. Decoder 207, in turn, supplies to the reset input of RS flip-flop 209 a second control pulse causing the $\overline{Q}$ output thereof to change from an inactive "0" state to an active "1" state. This allows a message in accordance with the truth table of FIG. 13 to be provided by microprocessor computer 29 through AND gate 213 to voice unit 55 so as to indicate to trainee rifleman 9, FIG. 1, and instructor 31, FIG. 1, whether or not trainee rifleman 9, FIG. 1, has scored a hit upon visual target 19, FIG. 1.

Thus, for the 1,0,0,0 data word supplied by latch 189 to microprocessor computer 29, microprocessor computer 29 will supply to voice unit 55 through AND gate 213 a 0,0,1,1,1,0 data word followed by a 0,0,0,0,1,1 data word, with both of the aforementioned data words being in accordance with the truth table of FIG. 13.

Voice unit 55 will, in turn, supply to headphones 59 and 61, FIG. 1, a recorded message, thereby indicating to trainee rifleman 9, FIG. 1, and instructor 31, FIG. 1, that trainee rifleman 9, FIG. 1, has fired high and to the left of visual target 19, FIG. 1.

Microprocessor computer 29 supplies the data words obtained from latches 189 through 197 to eight-bit microcomputer 215, which processes the aforementioned data words in accordance with the truth table of FIG. 9. Eight-bit microcomputer 215 supplies to data CRT display 65 a message to be displayed thereon so as to indicate to instructor 31, FIG. 1, whether trainee rifleman 9, FIG. 1, has scored a hit upon visual target 19, FIG. 1.

At this time it may be noted that a clock signal for eight-bit microcomputer 215 is supplied by microprocessor computer 29 through D flip-flop 218 to the X1 and X2 inputs of eight-bit microcomputer 215. D flip-flop 218, which functions as a frequency divider, divides the clock signal provided by microprocessor computer 29 by two, such that the aforementioned clock signal may be utilized by eight-bit microcomputer 215.

Thus, for the 1,0,0,0 data word provided by latch 189 to microprocessor computer 29, microprocessor computer 29 will supply to eight-bit microcomputer 215 a 0,0,1 rifle select address word, in accordance with the truth table of FIG. 14, the 1,0,0,0 data word in accordance with the truth table of FIG. 9, and an interrupt pulse to the write input of the aforementioned eight-bit microcomputer. Eight-bit microcomputer 215 will then process the aforementioned rifle select address word and data word, and supply to data CRT display 65 a message to be displayed thereon indicating the trainee rifleman 9, FIG. 1, has fired weapon 11 high and to the left of visual target 19, FIG. 1.

Control switches 204, 206, 208, 210, and 212, FIG. 15, when closed prevent the data words processed by eight-bit microcomputer 215 from being displayed by data CRT display 65. Thus, for example, control switch 204, FIG. 15, prevents the 1,0,0,0 data word obtained from latch 189 from being displayed by data CRT display 65. And control switches 206, 208, 210, and 212, FIG. 15, will respectively prevent the data words obtained from latches 191 through 197 from being displayed by data CRT display 65.

Referring now to FIGS. 2 and 4, whenever infrared target 23 appears upon screen 15, infrared projector 21 supplies through interface circuit 53 to the target present input of microprocessor computer 29 a target present signal. The target present signal actuates microprocessor computer 29 such that microprocessor computer 29 will measure in accordance with the flow chart of FIG. 8, the time until trainee rifleman 9, FIG. 1, fires weapon 11 at visual target 19. Microprocessor computer 29 also utilizes the target present signal provided by infrared projector 21 to determine the total number of visual targets 19 that appear upon screen 15 during a training session; visual targets 19 ignored by trainee rifleman 9, FIG. 1, during the training session; visual targets 19 shot at by trainee rifleman 9, FIG. 1, during the training session; and the total number of times trainee rifleman 9, FIG. 1, fired weapon 11 when no visual target 19 was present upon screen 15 during the training session.

When the training session is completed, microprocessor computer 29 supplies to decoder 207 a 1,1,0,1 data word in accordance with the truth table of FIG. 12 and a decode enable pulse. Decoder 207, in turn, supplies to the set input of RS flip-flop 209 a second control pulse, causing the Q output thereof to change from an inactive "0" state to an active "1" state. This allows a message to be provided by microprocessor computer 29 through AND gate 205 to data terminal 63, the aforementioned message to be in accordance with a Message Format I as follows:

MESSAGE FORMAT I
RIFLE: 11
YOUR RESULTS ARE:
TOTAL SHOTS: 1
HITS: 0
MISSES: 1
LOWS: 0
LOW RIGHT: 0
RIGHTS: 0
HIGH RIGHTS: 0
HIGHS: 0
HIGH LEFTS: 1
LOW LEFTS: 0
NO TARGET: 0
TARGETS IGNORED: 0
TARGETS SHOT AT: 1
AVERAGE REACTION TIME: 5.3 SECONDS

The above provides trainee rifleman 9, FIG. 1, and instructor 31, FIG. 1, with a written record of the total number of hits, misses and the specific areas of near miss for trainee rifleman 9, FIG. 1, during the training session.

Referring now to FIG. 8, there is shown a flow chart of a computer program utilized by microprocessor computer 29, FIG. 2, to determine in accordance with the truth table of FIG. 9 whether trainee rifleman 9, FIG. 1, has scored a hit or a miss upon visual target 19, FIG. 1. The aforementioned computer program is also utilized by microprocessor computer 29, FIG. 2, to determine the total number of visual targets 19, FIG. 2, that appear upon screen 15, FIG. 2, during the training session; visual targets 19 ignored by trainee rifleman 9, FIG. 1, during the training session; visual targets 19, FIG. 2, shot at by trainee rifleman 9, FIG. 1, during the training session; and the total number of times trainee rifleman 9, FIG. 1, fired weapon 11, FIG. 2, when no visual target 19, FIG. 2, was present upon screen 15, FIG. 1, during the training session.

Referring to FIGS. 2, 3, 4, and 8, the flow chart of FIG. 8 comprises program sequences 237–297. Program sequence 237 starts the computer program utilized by microprocessor computer 29. Program sequence 239 initializes a master timer, not shown, located within microprocessor computer 29, and the memory, not shown, of microprocessor computer 29. Program sequence 239 also provides that microprocessor computer 29 will send a message to data terminal 63 indicating that the training session is about to commence. Program sequence 239 then causes microprocessor computer 29 to supply to decoder 207 the 1,1,0,0 address word in accordance with the truth table of FIG. 12 and the enable pulse as discussed above, so as to activate voice unit 55. Program sequence 241 indicates that the training has begun. Program sequence 243 determines whether the five trainee riflemen 9, FIG. 1, are still in the training session.

Program sequence 245 determines whether visual target 19 is present upon screen 15, and/or whether weapons 11, 12, 14, 16, and/or 18, FIG. 1, have been fired. Program sequence 247 determines that either visual target 19 is present upon screen 15, and/or that weapons 11, 12, 14, 16, and/or 18, FIG. 1, have been fired.

Program sequence 249 determines whether visual target 19 is present upon screen 15. Program sequence 251 determines that visual target 19 is present on screen 15 upon receiving from infrared projector 23 the target present signal.

Program sequence 253 determines whether a target flag is set in an active "1" state. At this time it may be noted that prior to receiving the target present signal from infrared projector 21, the aforementioned target flag is set in an inactive "0" state. Thus, upon receiving the target present signal from infrared projector 21, the computer program of microprocessor computer 29 passes from program sequence 251 through program sequence 253 to program sequence 255.

Program sequence 255 sets the target flag of program sequence 253 to the active "1" state. Program sequence 255 also reads a target timer, not shown, located within microprocessor computer 29, and then stores in the memory of microprocessor computer 29 the time read from the aforementioned target timer such that whenever trainee rifleman 9, FIG. 1, fires weapon 11 at visual target 19, microprocessor computer 29 may determine the reaction time of trainee rifleman 9, FIG. 1. Program sequence 255 sets a real gone target flag to an inactive "0" state, the details of which will be discussed below. The aforementioned real gone target flag is also initialized to an active "1" state at the start of the training session by program sequence 239. Program sequence 255 sets a no target present test, the details of which will be discussed below, to an inactive "0" state.

Program sequence 257 determines whether one of the five weapons 11, 12, 14, 16, or 18 has been fired by scanning the master service request input of microprocessor computer 29. As discussed above, whenever one of the five weapons 11, 12, 14, 16, or 18 has been fired, the master service request input of microprocessor computer 29 will be in the active "1" state.

Program sequence 259 indicates that at least one of the five weapons 11, 12, 14, 16, and/or 18 has been fired by trainee rifleman 9, FIG. 1, and that visual target 19 is present upon screen 15.

Program sequence 261 causes microprocessor computer 29 to supply to decoder 207 an address word in accordance with the truth table of FIG. 12, thereby activating one of the latches 189, 191, 193, 195, or 197 such that the aforementioned activated latch will transfer the data word stored therein to microprocessor computer 29. Microprocessor computer 29 will process the data word in accordance with the truth table of FIG. 9 and then transfer to voice unit 55 a message in accordance with the truth table of FIG. 13.

Program sequence 263 indicates that visual target 19 is not present upon screen 15. Program sequence 265 determines whether at least one of the five weapons 11, 12, 14, 16, and/or 18 has been fired while visual target 19 was not present upon screen 15. For the no target present test of program sequence 265, which was set to an inactive "0" state by program sequence 255, to be in ac active "1" state, visual target 19 must not have been present upon screen 15 for a predetermined time interval of one second, and at least one of the five weapons 11, 12, 14, 16, and/or 18 must have been fired.

Program sequence 267 performs a function which is similar to that of program sequence 261, in that it obtains a data word stored by interface circuit 53, processes the data word in accordance with the truth table of FIG. 9, and then transfers to voice unit 55 a message in accordance with the truth table of FIG. 13.

At this time it may be noted that whenever at least one of the five weapons 11, 12, 14, 16, and/or 18 has been fired, and visual target 19 was not present for the predetermined time interval of one second, microprocessor computer 29 supplies to voice unit 55, in accordance with the truth table of FIG. 13, a 0,0,0,1,1,0 data word followed by a 0,0,0,1,1,1 data word, thereby indicating to trainee rifleman 9, FIG. 1, and instructor 31, FIG. 1, that visual target 19 was not present upon screen 15.

Program sequence 269 indicates that weapons 11, 12, 14, 16, and 18 have not been fired and that visual target 19 is not present upon screen 15.

Program sequence 271 determines whether the target flag of program sequence 251 is in the active "1" state. Program sequence 273 sets the target flag of program sequence 255 to an inactive "0" state.

Program sequence 275 determines whether the real gone target flag of program sequence 255 is in the active "1" state or the inactive "0" state. At this time it may be noted that whenever the real gone target flag of program sequence 255 is in the inactive "0" state, after a predetermined time interval of one second the aforementioned real gone target flag will be set to the active "1" state, thereby causing the computer program of microprocessor computer 29 to proceed from program sequence 275 to program sequence 241.

Whenever the real gone target flag is in the inactive "0" state, the computer program of microprocessor computer 29 will proceed to program sequence 277.

Program sequences 277 and 279 determine whether visual target 19 was present on screen 15 and then ignored by trainee rifleman 9, FIG. 1. The computer program of microprocessor computer 29 will then proceed to program sequence 281 whenever one of the five trainee rifleman 9, FIG. 1, fails to fire one of the aforementioned weapons 11, 12, 14, 16, or 18 at visual target 19 while visual target 19 was present on screen 15.

Program sequence 281 stores in the memory of microprocessor computer 29, the information that at least one of the five trainee riflemen 9, FIG. 1, failed to fire at visual target 19 when visual target 19 appeared on screen 15. The information is then supplied to eight-bit microcomputer 215, which processes the information and supplies to data CRT display 65 a message indicating visual target 19 was ignored by at least one of the five trainee riflemen 9, FIG. 1. The information that visual target 19 was ignored by at least one of the five trainee riflemen 9, FIG. 1, is also supplied by microprocessor computer 29 to data terminal 63 during program sequence 283 in accordance with Message Format I as discussed above.

Program sequence 281 also sets the real gone target flag to the active "1" state. Program sequence 281 sets a first shot flag to an active "1" state. The first shot flag is then utilized by program sequence 255 to determine the reaction time of trainee rifleman 9, FIG. 1, by measuring the time interval between the appearance of visual target 19 on screen 15 and the first shot fired by trainee rifleman 9 at visual target 19, as discussed above. The first shot flag will then be reset to an inactive "0" state after trainee rifleman 9 fires the first shot at visual target 19.

Program sequence 283 supplies the results of the training session to teletype 65 in accordance with Message Format I as discussed above.

Program sequence 285 stops the computer program utilized by microprocessor computer 29, thereby ending the training session.

Referring now to FIGS. 10 and 11, there are shown a pair of flow charts of a computer program utilized by eight-bit microcomputer 215, FIG. 4, to determine in accordance with the truth table of FIG. 9, whether trainee rifleman 9, FIG. 1, has scored a hit or a miss upon visual target 19, FIG. 1.

Referring to FIGS. 4 and 10, the flow chart of FIG. 10 comprises program sequences 301–325. Program sequence 301 resets eight-bit microcomputer 215 such that eight-bit microcomputer 215 may receive data words from microprocessor computer 29. Program sequence 303 initializes the cursor, not shown, of data CRT display 65 by placing the aforementioned cursor in the bottom left corner of data CRT display 65. Program sequence 305 is the start sequence of the computer program utilized by eight-bit microcomputer 215 to determine whether trainee rifleman 9, FIG. 1, has scored a hit or miss upon visual target 19, FIG. 1. Program sequence 307 determines whether there are data words stored in the memory of eight-bit microcomputer 215. When there are data words stored in the memory of eight-bit microcomputer 215, eight-bit microcomputer 215 proceeds to program sequence 309.

Program sequence 309 obtains a data word from the memory of eight-bit microcomputer 215 so as to allow the data word to be transferred to data CRT display 65, and determines which of the five weapons 11, 12, 14, 16 or 18, FIG. 1, provided the aforementioned data word. Program sequence 309 also changes the status of the memory of eight-bit microcomputer 215, thereby indicating whether there are data words remaining in the memory of eight-bit microcomputer 215.

Program sequence 311 determines whether control switches 204, 206, 208, 210, and/or 212 are closed, thus preventing the data words provided by weapons 11, 12, 14, 16, and/or 18, FIG. 1, to eight-bit microcomputer 215 fron being supplied to data CRT display 65 and displayed thereby.

Program sequence 313 positions the cursor of data CRT display 65 such that a message in accordance with the truth table of FIG. 9 may be transferred from eight-bit microcomputer 215 to data CRT display 65.

Program sequence 315 converts a data word into a message in accordance with the truth table of FIG. 9.

Program sequence 317 disables the write input of eight-bit microcomputer 215 such that eight-bit microcomputer 215 will not accept the interrupt pulse provided by microprocessor computer 29, and thus not accept a data word from a microprocessor computer 29.

Program sequences 319, 321, and 325 transfer the aforementioned message from eight-bit microcomputer 215 to data CRT display 65 for display thereby so as to indicate to instructor 31, FIG. 1, whether trainee rifleman 9, FIG. 1, has scored a hit upon visual target 19, FIG. 1.

Program sequence 323 enables the write input of eight-bit microcomputer 215 so as to allow eight-bit microcomputer 215 to accept from microprocessor computer 29 the interrupt pulse, and thereby allow a data word to be transferred from microprocessor computer 29 to eight-bit microcomputer 215 in accordance with the flow chart of FIG. 11, the details of which will be discussed below.

Whenever the interrupt pulse is provided by microprocessor computer 29 to eight-bit microcomputer 215, except in accordance with program sequence 317 of FIG. 10, the computer program of eight-bit microcomputer 215 follows the flow chart of FIG. 11 which comprises program sequences 331–341.

Program sequence 331 interrupts the data processing function so as to allow eight-bit microcomputer 215 to store the data word received from microprocessor computer 29. Program sequence 333 determines whether there is a storage location in the memory of eight-bit microcomputer 215 to store the data word provided by microprocessor computer 29. Program sequences 335 and 337 obtain the data words which appear at the rifle data inputs of eight-bit microcomputer 215 and store the aforementioned data words in the memory of eight-bit microcomputer 215. Program sequence 339 indicates whether a data word is stored in the memory of eight-bit microcomputer 215. Program sequence 341 returns the computer program of eight-bit microcomputer 215 to the flow chart of FIG. 10.

From the foregoing, it may readily be seen that the subject invention comprises a new, unique, and exceedingly useful marksman training system which constitutes a considerable improvement over the known prior art. Obviously, many modifications and variations of the present invention are possible in light of the above teachings. It is, therefore, to be understood that within the scope of the appended claims, the invention may be practiced otherwise than as specifically described.

What is claimed is:

1. A weapon training simulation system comprising in combination:

first projecting means having first and second outputs for displaying upon a screen a background scene including a visual target;

second projecting means having first and second outputs for displaying upon said screen an infrared target, and for producing a target present signal;

a plurality of weapons, each of which includes a trigger mechanism, and an ammunition magazine engagably attached thereto so as to allow said ammunition magazine to be removed therefrom;

means effectively connected between the said first projecting means and the said second projecting means for coordinately driving said first and second projecting means such that whenever at least one of a plurality of trainee riflemen correctly aims and fires one of said plurality of weapons at said infrared target a hit will be recorded upon said visual target;

a plurality of sensor means effectively and respectively attached to said plurality of weapons with each of said sensor means including a quartet of photodiodes, each photodiode of which is adopted for producing an analog output signal upon sensing said infrared target;

a plurality of circuit means, each circuit means of which has a quartet of signal inputs effectively and respectively connected to the outputs of the photodiodes of one of said plurality of sensor means, a reset input, a quartet of data outputs, a data ready strobe output, a trigger output, and each circuit means of which is mechanically coupled to the trigger mechanism of one of said plurality of weapons for providing, in response to said analog output signals, data word at the quartet of data outputs thereof whenever one of said trainee rifleman fires one of said weapons at said visual target, and for generating at the data ready strobe output thereof a data ready pulse whenever one of said trainee riflemen fires one of said weapons at said visual target;

an interface means having a plurality of data inputs effectively and respectively connected to the data outputs of said plurality of circuit means, a plurality of data ready strobe inputs respectively connected to the data ready strobe outputs of said plurality of circuit means, a target present input connected to the second output of said second projecting means, a serial data input, a quartet of decode select inputs, a decode enable input, a quartet of rifle data inputs, a trio of rifle select inputs, an initialization input, a write input, a clock input, a reset output connected to the reset inputs of said plurality of circuit means, a master service request output, a plurality of service request outputs, a quartet of data outputs, a voice unit enable output, a data terminal enable output, and a CRT output adopted for passing to the target present output thereof the target present signal supplied by said second projecting means, for receiving from each of said plurality of circuit means the data word provided thereby in response to the data ready pulse generated therefrom, and for storing therein the data words provided by said plurality of circuit means; and computer means having a quartet of data inputs respectively connected to the quartet of data outputs of said interface means, a target present input connected to the target present output of said interface means, a master sevice request input connected to the master service request output of said interface means, a plurality of service request inputs respectively connected to the plurality of service request outputs of said interface means, a data terminal input, a serial data output connected to the serial data input of said interface means, a quartet of decode select outputs respectively connected to the quartet of decode select inputs of said interface means, a decode enable output connected to the decode enable input of said interface means, a quartet of rifle data outputs respectively connected to the quartet of rifle data inputs of said interface means, a trio of rifle select outputs respectively connected to the trio of rifle select inputs of said interface means, an initialization output connected to the initialization input of said interface means, a write output connected to the write input of said interface means, a clock output connected to the clock input of said interface means adopted for supplying to said interface means a plurality of predetermined address words, each of said predetermined address words to effect the transfer of one of said data words stored by said interface means from said interface means to said computer means, for performing an analysis of said data words in accordance with a predetermined computer program so as to generate a plurality of predetermined messages, each of which is indicative of a hit, a miss, or a specific area of near miss, and for receiving the target present signal from said interface means so as to determine, in accordance with said predetermined computer program, a reaction time for each of said plurality of trainee riflemen whenever said plurality of trainee riflemen fire said plurality of weapons at said visual target.

2. The weapon training simulation system according to claim 1, wherein each of said plurality of weapons comprises a rifle.

3. The weapon training simulation system according to claim 1, wherein each of said plurality of circuit means comprises:

a quartet of sensor circuits each of which has a signal input, an enable input, and a reset input, with the signal inputs thereof connected to the outputs of said quartet of photodiodes, and the reset inputs thereof connected to the reset outputs of said interface means;

a voltage source;

a trigger switch mechanically coupled to the trigger mechanism of one of said plurality of weapons, said trigger switch having an input connected to said voltage source and a pair of outputs;

an auto-manual switch mounted upon one of said plurality of weapons, said auto-manual switch having an input connected to said voltage source, an auto output, and a manual output;

an RS flip-flop having a reset input connected to the first of the pair of outputs of said trigger switch, a set input connected to the second of the pair of outputs of said trigger switch, and a Q output;

a first one-shot multivibrator having an input connected to the Q output of said RS flip-flop and an output;

a pulse generator having an input connected to the Q output of said RS flip-flop and an output;

a first AND gate having a first input connected to the auto output of said auto-manual switch, a second input connected to the output of said pulse generator and an output;

a second AND gate having a first input connected to the output of said one-shot multivibrator, a second input connected to the manual output of said auto-manual switch, and an output;

an OR gate having a first input connected to the output of said first AND gate, a second input connected to the manual output of said auto-manual switch and an output;

a capacitor mounted within said ammunition magazine;

a second one-shot multivibrator having an input connected to said capacitor, and an output;

a counter having a reset input connected to the output of said second one-shot multivibrator, a clock input and an output;

a third AND gate having a first input connected to the output of said OR gate, a second input connected to the output of said counter, and an output;

a third one-shot multivibrator having an input connected to the output of said third AND gate, and an output connected to the clock input of said counter and the enable inputs of said quartet of sensor circuits;

a fourth AND gate having a first input connected to the output of said counter, and a second input connected to the output of said third one-shot multivibrator; and a fourth one-shot multivibrator having an input connected to the output of said third one-shot multivibrator.

4. The weapon training simulation system according to claim 3, wherein each of said quartet of sensor circuits comprises:

an active filter having an input effectively connected to the output of one of said quartet of photodiodes and an output;

a voltage comparator having a first input connected to the output of said active filter, a second input connected to a direct current voltage source and an output;

an AND gate having a first input connected to the output of said voltage comparator, a second input connected to the output of said third one-shot multivibrator, and an output; and a latch having a first input connected to the output of said AND gate, a second input connected to the reset output of said interface means, and an output.

5. The weapon training simulation system according to claim 1, wherein said interface means comprises:

a plurality of latches, each of which has a quartet of data inputs respectively connected to the data outputs of one of said circuit means, a data ready strobe input connected to the data ready strobe output of one of said sensor means, a data clear input, a data ready input, and an interrupt output;

an OR gate having a plurality of inputs respectively connected to the interrupt outputs of said plurality of latches;

a decoder having a quartet of decode select inputs respectively connected to the quartet of decode select outputs of said computer means, a decode enable input connected to the decode enable output of said computer means, a data clear output connected to the data clear inputs of said plurality of latches, a plurality of data ready outputs respectively connected to the data ready inputs of said plurality of latches, a first control output, and a second control output;

an RS flip-flop having a set input connected to the first control output of said decoder, a reset input connected to the second control output of said decoder, a Q output and a $\overline{Q}$ output;

a first AND gate having a first input connected to the serial data output of said computer means, and a second input connected to the Q output of said RS flip-flop;

a second AND gate having a first input connected to the serial data output of said computer means, and a second input connected to the Q output of said RS flip-flop;

a one-shot multivibrator having an input connected to the write output of said computer means and an output;

a D flip-flop having a D input connected to the clock output of said computer means, a Q output, and a $\overline{Q}$ output; and an eight-bit microcomputer having a quartet of rifle data inputs respectively connected to the quartet of rifle data outputs of said computer means, a trio of rifle select inputs respectively connected to the trio of rifle select outputs of said computer means, a write input connected to the output of said one-shot multivibrator, an initialization input connected to the initialization output of said computer means, an X1 input connected to the Q output of said D flip-flop, and an X2 input connected to the $\overline{Q}$ output of said D flip-flop.

6. The weapon training simulation system according to claim 1, further characterized by a data terminal having an input connected to the data terminal output of said interface means, and an output connected to the data terminal input of said computer means.

7. The weapon training simulation system according to claim 1, further characterized by an audio system having a first input connected to the second output of said first projecting means, and a second input connected to the voice unit enable output of said interface means.

8. The weapon training simulation system according to claim 7, wherein said audio system comprises:

an audio circuit having a first input connected to the second output of said first projecting means, a second input and an output;

a voice unit having an input connected to the voice unit enable output of said interface means, and an output connected to the second input of said audio circuit; and a plurality of headphones, each of which has an input effectively connected to the output of said audio circuit.

9. The weapon training simulation system according to claim 1, further characterized by a data CRT display having an input connected to the CRT output of said interface means.

10. The weapon training simulation system of claim 1, further characterized by a plurality of lasers, each of which is effectively attached to one of said plurality of weapons, and each of which has an input connected to the trigger output of one of said plurality of circuit means.

11. The weapon training simulation system of claim 1, further characterized by an infrared television camera spatially disposed downstream from said screen, said infrared television camera having an output.

12. The weapon training simulation system of claim 11, further characterized by an infrared target CRT display having an input connected to the output of said infrared television camera.

13. The simulation system according to claim 1, wherein said predetermined computer program comprises a computer program for performing a data processing function in accordance with the following truth table:

for a 1,1,1,1 word supplied to the quartet of data inputs of said computer, a first hit indicator message representing a hit emanates from said computer;

for a 0,1,0,0 word supplied to the quartet of data inputs of said computer, a second hit indicator message representing a high right target miss emanates from said computer;

for a 1,0,0,0 word supplied to the quartet of data inputs of said computer, a third hit indicator message representing a high left target miss emanates from said computer;

for a 1,1,0,0 word supplied to the quartet of data inputs of said computer, a fourth hit indicator message representing a high target miss emanates from said computer;

for a 1,1,0,0 word supplied to the quartet of data inputs of said computer, a fifth hit indicator message representing a low left target miss emanates from said computer;

for a 0,0,1,0 word supplied to the quartet of data inputs of said computer, a sixth hit indicator message representing a low right target miss emanates from said computer;

for a 1,0,0,1 word supplied to the quartet of data inputs of said computer, a seventh hit indicator message representing a left target miss emanates from said computer;

for a 0,1,1,0 word supplied to the quartet of data inputs of said computer, an eighth hit indicator message representing a right target miss emanates from said computer;

for a 0,0,1,1 word supplied to the quartet of data inputs of said computer, a ninth hit indicator message representing a low target miss emanates from said computer; and for a 0,0,0,0, word supplied to the quartet of data inputs of said computer, a tenth hit indicator message representing a miss emanates from said computer.

14. An electro-optic infantry weapons trainer comprising, in combination:

a visual projector having first and second outputs for displaying upon a screen a background scene including a visual target, said background scene including said visual target being chopped at a first predetermined frequency;

an infrared projector having first and second outputs for producing a target present signal and for projecting upon said screen an infrared target, said infrared target being chopped at a second predetermined frequency;

a weapon having a trigger mechanism, an intake port, and an ammunition magazine engagably attached thereto so as to allow said ammunition magazine to be removed therefrom;

a selsyn circuit effectively connected between said visual projector and said infrared projector for coordinately driving said visual and infrared projectors such that whenever a trainee rifleman correctly aims and fires said weapon at said infrared target, a hit will be recorded upon said visual target;

a sensor element effectively attached to said weapon, said sensor element having a quartet of photodiodes, each of which has an output and each of which is adopted for producing an analog output signal upon sensing said infrared target;

a quartet of sensor circuits, each of which has a signal input, an enable input, a reset input, and a data output, with the signal inputs thereof respectively connected to the outputs of said quartet of photodiodes, adopted for filtering said analog output signals produced by said quartet of photodiodes so as to pass only said analog output signals having said second predetermined frequency and for converting said passed analog output signals to digital logic data signals;

an enable circuit mechanically coupled to the trigger mechanism of said weapon and having an enable output connected to the enable inputs of said quartet of sensor circuits, a data ready strobe output, and a trigger output for generating an enable signal so as to allow the reading out of said digital logic data signals appearing at the data outputs of said quartet of sensor circuits whenever said trainee rifleman fires said weapon, for limiting to a predetermined number the times said trainee rifleman may fire said weapon, for allowing said trainee rifleman to fire said weapon in either an automatic mode or a manual mode, and for providing a data ready pulse whenever said trainee rifleman fires said weapon;

an interface circuit having a quartet of data inputs respectively connected to the data outputs of said quartet of sensor circuits, a data strobe ready input connected to the data strobe ready output of said enable circuit, a target present input connected to the second output of said infrared projector, a serial data input, a quartet of decode select inputs, a decode enable input, a quartet of rifle data inputs, a trio of rifle select inputs, an initialization input, a write input, a clock input, a reset output connected to the reset inputs of said quartet of sensor circuits, a target present output, a master service request output, a service request output, a quartet of data outputs, a voice unit enable output, a data terminal enable output, and a CRT output adopted for passing to the target present output thereof the target present signal supplied by said infrared projector, and for storing the digital logic data signals appearing at the data outputs of said quartet of sensor circuits in response to the data ready pulse provided by said enable circuit; and a computer having a quartet of data inputs respectively and effectively connected to the quartet of data outputs of said interface circuit, a target present input connected to the target present output of said interface circuit, a master service request input connected to the master service request output of said interface circuit, a service request input connected to the service request output of said interface circuit, a data terminal input, a serial data output connected to the serial data input of said interface circuit, a quartet of decode select outputs respectively connected to the quartet of decode select inputs of said interface circuit, a decode enable output connected to the decode enable input of said interface circuit, a quartet of rifle data outputs respectively connected to the quartet of rifle data inputs of said interface circuit, a trio of rifle select outputs respectively connected to the trio of rifle select inputs of said interface circuit, an initialization output connected to the initialization input of said interface circuit, a write output connected to the write input of said interface circuit, and a clock output connected to the clock input of said interface circuit adopted for supplying to said interface circuit a predetermined address word so as to effect the transfer of the digital logic data signals stored by said interface circuit from said interface circuit to said computer, for performing an analysis of said digital logic data signals in accordance with a predetermined computer program so as to produce a predetermined message indicative of a hit, a miss, or a specific area of near miss, and for receiving the target present signal from said interface circuit so as to determine, in accordance with said predetermined computer program, a reaction time for said trainee rifleman whenever said trainee rifleman fires said weapon at said visual target.

15. The electro-optic infantry weapons trainer according to claim 14, wherein said first predetermined frequency is forty-eight hertz.

16. The electro-optic infantry weapons trainer according to claim 14, wherein said second predetermined frequency is ninety-six hertz.

17. The electro-optic infantry weapons trainer according to claim 14, wherein each of said sensor circuits comprises:

an active filter having an input effectively connected to the output of one of said quartet of photodiodes and an output;

a voltage comparator having a first input connected to the output of said active filter, a second input connected to a direct current voltage source and an output;

an AND gate having a first input connected to the output of said voltage comparator, a second input connected to the enable output of said enable circuit, and an output; and a latch having a first input connected to the output of said AND gate, a second input connected to the reset output of said interface circuit, and an output.

18. The electro-optic infantry weapons trainer according to claim 14, wherein said weapon comprises a rifle.

19. The electro-optic infantry weapons trainer according to claim 14, wherein said enable circuit comprises:

a voltage source;

a trigger switch mechanically coupled to the trigger mechanism of said weapon, said trigger switch having an input connected to said voltage source and a pair of outputs;

an auto-manual switch mounted upon said weapon, said auto-manual switch having an input connected to said voltage source, an auto output, and a manual output;

an RS flip-flop having a reset input connected to the first of the pair of outputs of said trigger switch, a set input connected to the second of the pair of outputs of said trigger switch, and a Q output;

a first one-shot multivibrator having an input connected to the Q output of said RS flip-flop and an output;

a pulse generator having an input connected to the Q output of said RS flip-flop and an output;

a first AND gate having a first input connected to the auto output of said auto-manual switch, a second input connected to the output of said pulse generator, and an output;

a second AND gate having a first input connected to the output of said one-shot multivibrator, a second input connected to the manual output of said auto-manual switch, and an output;

an OR gate having a first input connected to the output of said first AND gate, a second input connected to the output of said second AND gate, and an output;

a capacitor mounted within said ammunition magazine;

a second one-shot multivibrator having an input connected to said capacitor, and an output;

a counter having a reset input connected to the output of said second one-shot multivibrator, a clock input, and an output;

a third AND gate having a first input connected to the output of said OR gate, a second input connected to the output of said counter, and an output;

a third one-shot multivibrator having an input connected to the output of said third AND gate, and an output connected to the clock input of said counter;

a fourth AND gate having a first input connected to the output of said counter, and a second input connected to the output of said third one-shot multivibrator; and a fourth one-shot multivibrator having an input connected to the output of said third one-shot multivibrator.

20. The electro-optic infantry weapons trainer according to claim 14, wherein said interface circuit comprises:

a latch having a quartet of data inputs respectively connected to the data outputs of said quartet of sensor circuits, a data ready strobe input connected to the data ready strobe output of said enable circuit, a data clear input, and a data ready input;

a decoder having a quartet of decode select inputs respectively connected to the quartet of decode select outputs of said computer, a decode enable input connected to the decode enable output of said computer, a data clear output connected to the data clear input of said latch, a data ready output connected to the data ready input of said latch, a first control output, and a second control output;

an RS flip-flop having a set input connected to the first control output of said decoder, a reset input connected to the second control output of said decoder, a Q output, and a $\overline{Q}$ output;

a first AND gate having a first input connected to the serial data output of said computer, and a second input connected to the Q output of said RS flip-flop;

a second AND gate having a first input connected to the serial data output of said computer, and a second input connected to the $\overline{Q}$ output of said RS flip-flop;

a one-shot multivibrator having an input connected to the write output of said computer, and an output;

a D flip-flop having a D input connected to the clock output of said computer, a Q output, and a $\overline{Q}$ output; and an eight-bit microcomputer having a quartet of rifle data inputs respectively connected to the quartet of rifle data outputs of said computer, a trio of rifle select inputs respectively connected to the trio of rifle select outputs of said computer, an initialization input connected to the initialization output of said computer, a write input connected to the output of said one-shot multivibrator, an X1 input connected to the Q output of said D flip-flop, and an X2 input connected to the $\overline{Q}$ output of said D flip-flop.

21. The electro-optic infantry weapons trainer according to claim 14, further characterised by a four blade shutter rotatably mounted within said infrared projector for chopping said infrared target at said second predetermined frequency.

22. The electro-optic infantry weapons trainer according to claim 14, further characterized by a rifle recoil simulator having an input connected to the trigger output of said enable circuit, and an output port effectively connected to the intake port of said weapon for exerting upon said trainee rifleman a recoil motion whenever said trainee rifleman fires said weapon.

23. The electro-optic infantry weapons trainer according to claim 14, further characterized by a data terminal having an input connected to the data terminal enable output of said interface circuit, and an output connected to the data terminal input of said computer.

24. The electro-optic infantry weapons trainer according to claim 14, further characterized by an audio system having a first input connected to the second output of said visual projector, and a second input connected to the voice unit enable output of said interface circuit.

25. The electro-optic infantry weapons trainer according to claim 24, wherein said audio system comprises:

an audio circuit having a first input connected to the second output of said visual projector, a second input, and an output;

a voice unit having an input connected to the voice unit enable output of said interface circuit, and an output connected to the second input of said audio circuit; and a pair of headphones, each of which has an input effectively connected to the output of said audio circuit.

26. The electro-optic infantry weapons trainer of claim 25, wherein said audio circuit comprises:

a mixer having a first input connected to the second output of said visual projector, a second input connected to the output of said voice unit, and an output; and an amplifier having an input connected to the output of said mixer.

27. The electro-optic infantry weapons trainer of claim 14, further characterized by a data CRT display having an input connected to the CRT output of said interface circuit.

28. The electro-optic infantry weapons trainer of claim 14, further characterized by a laser effectively attached to said weapon, said laser having an input connected to the trigger output of said enable circuit for projecting a laser beam spot onto said screen whenever said trainee rifleman fires said weapon.

29. The electro-optic infantry weapons trainer of claim 14, further characterized by an infrared television camera spatially disposed downstream from said screen, said infrared television camera having an output.

30. The electro-optic infantry weapons trainer of claim 29, further characterized by an infrared target CRT display having an input connected to the output of said infrared television camera.

31. A weapon fire simulation system comprising, in combination:

projection apparatus having a plurality of outputs for simultaneously and coordinately projecting onto a screen a background scene including a visual target and an infrared target;

a weapon having a trigger mechanism attached thereto;

a sensor element attached to said weapon, said sensor element having a quartet of photodiodes, each of which is adapted for producing an analog output signal upon sensing said infrared target;

a quartet of sensor circuits, each of which has a signal input and an enable input, and a data output, with the signal inputs thereof respectively connected to the outputs of said quartet of photodiodes;

an enable circuit mechanically coupled to the trigger mechanism of said weapon and having an enable output connected to the enable inputs of said quartet of sensor circuits, and a data ready strobe output, for generating an enable signal and providing a data ready pulse so as to allow the reading out of the data appearing at the data outputs of said quartet of sensor circuits whenever said trigger mechanism is operated;

an interface circuit having a quartet of data inputs respectively connected to the quartet of data outputs of said sensor circuits, a data ready strobe input connected to the data ready strobe of said enable circuit, a plurality of computer inputs, and a plurality of computer outputs, for receiving from said sensor circuits the data word provided thereby, and for storing said data word therein; and a computer having a plurality of inputs respectively connected to the computer outputs of said interface circuit, and a plurality of outputs respectively connected to the computer inputs of said interface circuit, for supplying to said interface circuit a predetermined address word so as to effect the transfer of said data word from said interface circuit to said computer, wherein said computer performs an analysis of said data word in accordance with a predetermined computer program stored therein so as to indicate to a trainee rifleman whether said trainee rifleman has scored a hit upon said visual target.

* * * * *